US007654095B2

(12) United States Patent
Sullivan

(10) Patent No.: US 7,654,095 B2
(45) **Date of Patent: *Feb. 2, 2010**

(54) ENERGY TRANSFER APPARATUS AND METHODS

(75) Inventor: Shaun E. Sullivan, Salem, OR (US)

(73) Assignee: GreenCentAire, LLC, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/132,158

(22) Filed: Jun. 3, 2008

(65) Prior Publication Data

US 2008/0303283 A1 Dec. 11, 2008

Related U.S. Application Data

(63) Continuation of application No. 11/937,569, filed on Nov. 9, 2007.

(60) Provisional application No. 60/942,401, filed on Jun. 6, 2007.

(51) Int. Cl.
*F25B 9/02* (2006.01)

(52) U.S. Cl. ..... 62/5

(58) Field of Classification Search ..... 62/5, 62/467

See application file for complete search history.

(56) References Cited

U.S. PATENT DOCUMENTS

| | | | |
|---|---|---|---|
| 1,952,281 | A | 3/1934 | Ranque |
| D184,490 | S | 2/1959 | Petrie |
| 2,920,457 | A | 1/1960 | Bartlett, Jr. |
| D191,304 | S | 9/1961 | Lind |
| 3,074,243 | A | 1/1963 | Tilden |
| 3,103,104 | A | 9/1963 | Shackson |
| 3,173,273 | A | 3/1965 | Fulton |
| 3,208,229 | A | 9/1965 | Fulton |
| 3,277,238 | A | 10/1966 | Sharp |
| D208,405 | S | 8/1967 | Dixon |
| 3,461,676 | A | 8/1969 | Toelke |
| D216,886 | S | 3/1970 | Myers |
| 3,522,710 | A | 8/1970 | Petrovich |
| 3,630,040 | A | 12/1971 | Goldfarb |
| 3,654,768 | A | 4/1972 | Inglis |
| 3,786,643 | A | 1/1974 | Anderson |
| D233,039 | S | 10/1974 | Dixon |
| 3,969,908 | A | 7/1976 | Lawless |

(Continued)

FOREIGN PATENT DOCUMENTS

| | | |
|---|---|---|
| EP | 0676599 | 10/1995 |

(Continued)

OTHER PUBLICATIONS

S. Lin, "A Heat Transfer Relation for Swirl Flow in a Vortex Tube," The Canadian J. of Chem Eng., vol. 68, No. 6, Dec. 1990, pp. 944-947.

(Continued)

*Primary Examiner*—William C Doerrler
(74) *Attorney, Agent, or Firm*—Fredrikson & Byron, PA

(57) ABSTRACT

The invention provides an energy transfer apparatus having an energy transfer chamber (optionally bounded by an energy transfer tube) in which rotating flow is established. Preferably, the apparatus has a cold-fluid-discharge end and a hot-fluid-discharge end. Also provided are methods of using such apparatuses.

71 Claims, 11 Drawing Sheets

U.S. PATENT DOCUMENTS

| | | | | |
|---|---|---|---|---|
| 3,982,378 | A | 9/1976 | Sohre | |
| 4,022,599 | A | 5/1977 | Wilson | |
| 4,240,261 | A | 12/1980 | Inglis | |
| D257,787 | S | 1/1981 | Armbruster | |
| 4,305,339 | A | 12/1981 | Inglis | |
| 4,333,754 | A | 6/1982 | Peter | |
| D296,466 | S | 6/1988 | Gratton | |
| D298,453 | S | 11/1988 | Gratton | |
| 5,010,736 | A | 4/1991 | York | |
| 5,533,354 | A | 7/1996 | Pirkle | |
| 5,561,982 | A | 10/1996 | Tunkel | |
| 5,623,829 | A | 4/1997 | Nutter | |
| 5,685,475 | A | 11/1997 | Jairazbhoy | |
| D401,313 | S | 11/1998 | Murakami | |
| 5,911,740 | A | 6/1999 | Tunkel | |
| 5,937,654 | A | 8/1999 | Tunkel | |
| D415,564 | S | 10/1999 | Sendo | |
| 5,966,942 | A | 10/1999 | Mitchell | |
| D428,978 | S | 8/2000 | Ito | |
| 6,109,566 | A | 8/2000 | Tunkel | |
| 6,119,477 | A | 9/2000 | Chan | |
| 6,158,237 | A | 12/2000 | Riffat | |
| 6,289,679 | B1 | 9/2001 | Tunkel | |
| 6,305,183 | B1 | 10/2001 | Mukai | |
| 6,355,129 | B1 | 3/2002 | Paulus | |
| 6,398,851 | B1 | 6/2002 | Bose | |
| 6,401,463 | B1 | 6/2002 | Dukhan | |
| 6,402,047 | B1 | 6/2002 | Thomas | |
| 6,425,249 | B1 | 7/2002 | Cho | |
| 6,434,968 | B2 | 8/2002 | Buchholz | |
| 6,442,947 | B1 | 9/2002 | Mitchell | |
| 6,574,968 | B1 | 6/2003 | Symko | |
| 6,804,967 | B2 | 10/2004 | Symko | |
| 6,990,817 | B1 | 1/2006 | Bhatia | |
| 7,121,098 | B2 * | 10/2006 | Hatcher | 62/5 |
| 2001/0002588 | A1 | 6/2001 | Salber | |
| 2001/0003702 | A1 | 6/2001 | Luvchak | |
| 2001/0016172 | A1 | 8/2001 | Fukuoka | |
| 2001/0020366 | A1 | 9/2001 | Cho | |
| 2001/0025478 | A1 | 10/2001 | Fineblum | |
| 2001/0027857 | A1 | 10/2001 | Emrich | |
| 2001/0031393 | A1 | 10/2001 | Oda | |
| 2001/0032477 | A1 | 10/2001 | Schlom | |
| 2001/0040062 | A1 | 11/2001 | Illingworth | |
| 2001/0041136 | A1 | 11/2001 | Fujinaka | |
| 2001/0042380 | A1 | 11/2001 | Cho | |
| 2001/0048877 | A1 | 12/2001 | Illingworth | |
| 2001/0048900 | A1 | 12/2001 | Bardell | |
| 2001/0052411 | A1 | 12/2001 | Pantow | |
| 2002/0007645 | A1 | 1/2002 | Jeuch | |
| 2002/0007853 | A1 | 1/2002 | Fazekas | |
| 2002/0009364 | A1 | 1/2002 | Otsuka | |
| 2002/0025864 | A1 | 2/2002 | Barfield | |
| 2002/0046830 | A1 | 4/2002 | Ulrich | |
| 2002/0051719 | A1 | 5/2002 | Shiibayashi | |
| 2002/0056281 | A1 | 5/2002 | Bieberich | |
| 2002/0062650 | A1 | 5/2002 | Dukhan | |
| 2002/0064739 | A1 | 5/2002 | Boneberg | |
| 2002/0066278 | A1 | 6/2002 | Cho | |
| 2002/0068847 | A1 | 6/2002 | Riach, Jr. | |
| 2002/0073848 | A1 | 6/2002 | Cho | |
| 2002/0074105 | A1 | 6/2002 | Hayashi | |
| 2002/0074870 | A1 | 6/2002 | Vandervort | |
| 2002/0074874 | A1 | 6/2002 | Tong | |
| 2002/0075171 | A1 | 6/2002 | Kuntman | |
| 2002/0076323 | A1 | 6/2002 | Fujinaka | |
| 2002/0076327 | A1 | 6/2002 | Houten | |
| 2002/0079058 | A1 | 6/2002 | Okumura | |
| 2002/0080680 | A1 | 6/2002 | Proper | |
| 2002/0081468 | A1 | 6/2002 | Shioya | |
| 2002/0085448 | A1 | 7/2002 | Phillips | |
| 2002/0088273 | A1 | 7/2002 | Harness | |
| 2002/0090295 | A1 | 7/2002 | Torii | |
| 2002/0092119 | A1 | 7/2002 | Vystrcil | |
| 2002/0092449 | A1 | 7/2002 | Gutmark | |
| 2002/0092565 | A1 | 7/2002 | Muramatsu | |
| 2002/0093128 | A1 | 7/2002 | Koffron | |
| 2002/0094270 | A1 | 7/2002 | Ito | |
| 2002/0095741 | A1 | 7/2002 | Inoue | |
| 2002/0096471 | A1 | 7/2002 | Miller, III | |
| 2002/0100582 | A1 | 8/2002 | Oldenburg | |
| 2002/0102181 | A1 | 8/2002 | Salbilla | |
| 2002/0105190 | A1 | 8/2002 | Thomas | |
| 2002/0106275 | A1 | 8/2002 | Harvey | |
| 2002/0109518 | A1 | 8/2002 | Saito | |
| 2002/0110469 | A1 | 8/2002 | Fukuoka | |
| 2002/0110500 | A1 | 8/2002 | Moore | |
| 2002/0110735 | A1 | 8/2002 | Farnham | |
| 2002/0110814 | A1 | 8/2002 | Remacle | |
| 2002/0110899 | A1 | 8/2002 | Wheatcroft | |
| 2003/0192324 | A1 | 10/2003 | Smith | |
| 2004/0000150 | A1 | 1/2004 | Symko | |
| 2004/0216468 | A1 | 11/2004 | Hatcher | |
| 2004/0231341 | A1 | 11/2004 | Smith | |
| 2005/0000233 | A1 | 1/2005 | Hao | |
| 2006/0150643 | A1 | 7/2006 | Sullivan | |

FOREIGN PATENT DOCUMENTS

| | | |
|---|---|---|
| EP | 0684433 | 11/1995 |
| JP | 62-196561 | 8/1987 |
| RU | 2079067 | 5/1997 |
| SE | 1139939 | 2/1985 |
| SU | 377590 | 8/1973 |
| SU | 1135974 | 1/1985 |
| SU | 1208430 | 1/1986 |
| WO | WO9419653 | 9/1994 |

OTHER PUBLICATIONS

P. Kittel, "A Short History of Pulse Tube Refrigerators" website: http://irtek.arc.nasa.gov/CryoPTHist.html, Mar. 3, 2005.

B. Vonnegut, "A Vortex Whistle," The Journal of the Acoustical Society of America, vol. 26, Nos. 1-6, 1954, pp. 18-20.

M. Kurosaka et al., "Acoustic Streaming Induced by the "Vortex Whistle" is the Cause of the Ranque-Hilsch Effect", "Session G. Physical Acoustics I: Timely Topics" 104th Meeting: Acoustical Society of America, J. Acoust. Soc. Am. Suppl. 1, vol. 72, Fall 1982, pp. S12-S13.

Byoung-Gook Loh et al., "Acoustic Streaming Induced by Ultrasonic Flexural Vibrations and Associated Enhancement of Convective Heat Transfer," Acoustical Society of America, vol. 111, No. 2, Feb. 2002, pp. 875-883.

M. Kurosaka, "Acoustic Streaming in Swirling Flow and the Ranque-Hilsch (Vortex-Tube) Effect," Journal of Fluid Mechanics, vol. 124, Cambridge University Press, Cambridge, Nov. 1982, pp. 137-172.

F.C. Hooper, "An Electric Dew Point Meter Cooled by the Vortex Tube," Refrigerating Engineering, vol. 60, No. 11, Nov. 1952, pp. 1196-1197.

T. Blatt et al., "An Experimental Investigation of an Improved Vortex Cooling Device," Am. Soc. Mech. Eng., 1963, pp. 1-8.

F.C. Hooper, "An Improved Expansion Process for the Vapour Refrigeration Cycle," Proceedings of Fourth Canadian Congress of Applied Mechanics, May 28-Jun. 1, 1973, pp. 811-812.

K. Stephan et al., "An Investigation of Energy Separation in a Vortex Tube," International Journal of Heat and Mass Transfer, vol. 26, No. 3, Mar. 1983, pp. 341-348.

Deissler et al., "Analysis of the Flow and Energy Separation in a Turbulent Vortex," International Journal of Heat and Mass Transfer, vol. 1, 1960, pp. 173-191.

M.H. Saidi et al., "Experimental modeling of vortex tube refrigerator," Applied Thermal Engineering:23, 2003, pp. 1971-1980.

N. Pimental et al., "Effectiveness of a Vortex Tube Microclimate Cooling System" Aviation, Space and Environmental Medicine, vol. 58, No. 5, May 1987, p. 495.

U. Behera et al., "CFD analysis and experimental investigations towards optimizing the parameters of Ranque-Hilsch vortex tube," International Journal of Heat and Mass Transfer: 48, 2005, pp. 1961-1972.
D. Guillaume et al., "Demonstrating the achievement of lower temperatures with two-stage vortex tubes," Review of Scientific Instruments, vol. 72, No. 8, Aug. 2001, pp. 3446-3448.
Kluge, "Die Stellung des Wirbelrohrs in der Reihe der Kalfgasmaschinen", Luft und Kaltetechnik 1970, pp. 139-143, with English-language abstract.
He Shu et al., "Effect of Nozzles on Energy Separation Performance of Vortex Tube," Journal of Chemical Industry and Engineering (China), vol. 56, No. 11, Nov. 2005 (Includes English-language abstract).
H. Takahama et al., "Energy Separation in Vortex Tubes with a Divergent Chamber," Am. Soc. Mech. Eng., vol. 103, May 1981, pp. 196-203.
"EXAIR® Selecting the Right Vortex Tube" website: http://www.exair.com/vortextube/vt_selecting.htm, Mar. 3, 2005.
G. Goglia et al., "Experimental and Analytical Studies in Fluids," Old Dominion University Research Foundation, Sep. 1984, pp. 1-95.
H.H. Bruun, "Experimental Investigation of the Energy Separation in Vortex Tubes," The Journal of Mechanical Engineering Science, vol. 11, No. 6, Dec. 1969, pp. 567-582.
P. Promvonge et al., "Experimental Investigation of Temperature Separation in a Vortex Tube Refrigerator With Snail Entrance," AJSTD, vol. 21, Issue 4, 2004, pp. 297-307.
He Shu et al., "Experimental study on the effect of the inlet pressure on the performance of vortex tube," Acta Aerodynamica Sinica (China), vol. 24, No. 4, Dec. 2006 (Includes English-language abstract).
S. Piralishvili et al., "Flow and Thermodynamic Characteristics of Energy Separation in a Double-Circuit Vortex Tube—An Experimental Investigation," Experimental Thermal and Fluid Science, vol. 12, No. 4, May 1996, pp. 399-410.
F.C. Hooper et al., "Pressure Effects on Bubble Growth in the Flashing of Superheated Water," Proceedings of Fourth International Heat Transfer Conference—Paris-Versailles, vol. V, 1970, pp. 1-11.
S. Zhou et al., "Inlet pressure and the flow rate of air-conditioning control cold eddy performance study," App. Science Foundation and Eng. J., 2006, 3 pages.
A. Crocker et al., "Investigation of Enhanced Vortex Tube Air Separators for Advanced Space Transportation", 40th Joint Propulsion Conference & Exhibit, Ft. Lauderdale, FL, Jul. 11-14, 2004, pp. 1-11.
V.S. Martynovskii et al., "Investigation of the Vortex Thermal Separation Effect for Gases and Vapors," Soviet Physics—Technical Physics, vol. 1, No. 10, 1957, pp. 2233-2242.
P. Promvonge et al., "Investigation on the Vortex Thermal Separation in a Vortex Tube Refrigerator," SCIENCEASIA 31, 2005, pp. 215-223.
B. Ahlborn et al., "Limits of temperature separation in a vortex tube," J. Phys. D: Appl. Phys. 27, 1994, pp. 480-488.
W.F. Lienhard, et al., "Man Cooling by a Vortex Tube Device", Environmental Health, American Medical Association Publication, vol. 9, Jul.-Dec. 1964, pp. 377-386.
Tetsushi Biwa, "New Acoustic Devices Based on Thermoacoustic Energy Conversion," JSME Ted Newsletter, No. 41, 2003.
W. Fröhlingsdorf et al., "Numerical investigations of the compressible flow and the energy separation in the Ranque-Hilsch vortex tube," International Journal of Heat and Mass Transfer: 428, 1999, pp. 415-422.
P. Promvonge et al., "Numerical Simulation of Turbulent Compressible Vortex-Tube Flow," 3rd ASME/JSME Joint Fluids Engineering Conference, Jul. 18-23, 1999, pp. 1-8.
Y. Soni et al., "Optimal Design of the Ranque-Hilsch Vortex Tube", Transactions of the ASME, The American Soc. of Mechanical Engineers, vol. 97, No. 2, May 1975, pp. 316-317.
H. Takahama et al., "Performance Characteristics of Energy Separation in a Steam-Operated Vortex Tube," International Journal of Engineering Science, vol. 17, No. 6, 1979, pp. 735-744.
M. Kurosaka et al., "Ranque-Hilsch Effect Revisited: Temperature Separation Traced to Orderly Spinning Waves or Vortex Whistle", AIAA/ASME 3rd Joint Thermophysics, Fluids, Plasma and Heat Transfer Conference, Jun. 7-11, 1982, pp. 1-13.
C. Fulton, "Ranque's Tube," Refrigerating Engineering, vol. 58, No. 5, May 1950, pp. 473-479.
B. Ahlborn et al., "Secondary flow in a vortex tube," Fluid Dynamics Research. vol. 21, 1997, pp. 73-86.
"Vortex Tube Refrigeration", Refrigeration and Air Conditioning, vol. 75, No. 893, Aug. 1972, pp. 49-50.
H. Takahama, "Studies on Vortex Tubes," Japan Society of Mechanical Engineers, vol. 8, No. 31, 1965, pp. 433-440.
A. Williams, "The Cooling of Methane with Vortex Tubes," The Journal of Mechanical Engineering Science, vol. 13, No. 6, Institution of Mechanical Engineers, Dec. 1971, pp. 369-375.
B.K. Ahlborn et al., "The Heat Pump in a Vortex Tube," J. Non-Equilib. Thermodyn. vol. 23, No. 2, 1998, pp. 159-165.
J. Wheatley et al., "The Natural Heat Engine", Los Alamos Science, Fall 1986, pp. 2-32.
A. Gutsol, "The Ranque effect," Physics—Uspekhi, vol. 40, No. 6, 1997, pp. 639-658.
B.K. Ahlborn et al., "The Vortex Tube as a Classic Thermodynamic Refrigeration Cycle," J. App. Physics. vol. 88, No. 6, Sep. 15, 2000, pp. 3645-3653.
D. Scott et al., "The Use of a Vortex Flow Tube in Refrigeration Evaporators," The Institute of Refrigeration, vol. 60, 1963-64, pp. 159-170.
R. Hilsch, "The Use of the Expansion of Gases in a Centrifugal Field as Cooling Process," The Review of Scientific Instruments, vol. 18, No. 2, Feb. 1947, pp. 108-113.
R. Aronson, "The Vortex Tube: Cooling with Compressed Air", Machine Design, vol. 48, No. 28, Dec. 9, 1976, pp. 140-143.
G. Scheper, "The Vortex Tube—Internal Flow Data and A Heat Transfer Theory," Refrigerating Engineering, vol. 59, No. 10, Oct. 1951, pp. 985-1018.
Y. Cao et al., "Thermodynamics Prediction of the Vortex Tube Applied to a Mixed-Refrigerant Auto-Cascade J-T Cycle", Proceedings of the 12th International Cryocooler Conference Held Jun. 18-20, 2002, Cryocoolers 12, pp. 621-626.
M. Sibulkin, "Unsteady, viscous, circular flow—Part 3. Application to the Ranque-Hilsch vortex tube," J. Fluid Mechanics, vol. 12, Part 2, Feb. 1962, pp. 269-293.
Y. Lee et al., "Vortex Tube Air Separation Applications for Air Collection Cycle Hypersonic Vehicles", 41st Aerospace Sciences Meeting and Exhibit Jan. 9, 2003, Reno, NV, pp. 1-11.
H. Zhongyue et al., "Vortex tube and flow-rate characteristics," J. Dalian Univ. of Technology, 1994 (Includes English-language abstract).
R. Boggs, "Vortex Tube Cools from Both Ends", Design News, Mar. 17, 1969, p. 58.
J. Lewins et al, "Vortex Tube Optimization Theory", Energy 24 (1999), pp. 931-943.
K. Kurosaka, "Vortex Whistle: An Unsteady Phenomenon in Swirling Flow Field", AIAA 19th Aerospace Sciences Meeting, Jan. 12-15, 1981, pp. 1-9.
http://en.wikipedia.org/wiki/Thermoacoustic_hot_air_engine, May 9, 2008, 4 pages.
Steven L. Garrett, Scott Backhaus, "The Power of Sound", American Scientist, Nov.-Dec. 2000, vol. 88, No. 6, pp. 516-525.
L. Khodorkov, N.V. Poshernev, and M.A. Zhidkov, "The vortex-tube—a universal device for heating, cooling, cleaning, and drying gases and separating gas mixture." Chemical and Petroleum Engineering, 39(7-8):409-415, Jul. 2003.
Yenus A. Cengel and Robert H. Turner, "Fundaments of Thermal-Fluid Sciences—2nd Edition" McGraw-Hill 2005, Chapter 14, pp. 605-659.
A.I. Azarov, "Trends In Improvement In Serial Swirl Tubes", Khimicheskoe Neftegazovoe Mashinostroenie, 2004 vol. 7, pp. 24-27 (Includes English-language abstract).
U.S. Appl. No. 60/407,200, filed Aug. 28, 2002.
U.S. Appl. No. 60/527,239, filed Dec. 5, 2003.
"U.S. Appl. No. 11/198,617 Non Final Office Action mailed Jul. 17, 2008", 8 pgs.

Database WPI Week 197407 Thomson Scientific, London, GB; AN 1974-12871V XP002498285—SU377590 (Moscow Bauman Tech School) Aug. 2, 1973, 3 pages (including English-language abstract).
Database WPI Week 198534 Thomson Scientific, London, GB; AN 1985-208367 XP002498286—SU1135974 (Odessa Refrig Ind Res) Jan. 23, 1985, 4 pages (including English-language abstract).
Database WPI Week 198606 Thomson Scientific, London, GB; AN 1986-040640 XP002498287—SU1139939 (Kazan Chem-Photo) Feb. 15, 1985, 5 pages (including English-language abstract).
Database WPI Week 198637 Thomson Scientific, London, GB; AN 1986-244401 XP002498288—SU1208430 (Moscow Bauman Tech School) Jan. 30, 1986, 3 pages (including English-language abstract).
Database WPI Week 199747 Thomson Scientific, London, GB; AN 1977-511144 XP002498289—RU2079067 (Churkin RK) May 10, 1997, 7 pages (including English-language abstract).
English-language translation of SU377590 (Moscow Bauman Tech School) Aug. 2, 1973, 1 page.
English-language translation of SU1135974 (Odessa Refrig Ind Res) Jan. 23, 1985, 3 pages.
English-language translation of SU1208430 (Moscow Bauman Tech School) Jan. 30, 1986, 2 pages.
English-language translation of He Shu et al., "Effect of Nozzles on Energy Separation Performance of Vortex Tube," Journal of Chemical Industry and Engineering (China), vol. 56, No. 11, Nov. 2005.
International Search Report and Written Opinion, dated Sep. 2, 2009 for PCT Application No. PCT/US2008/065090, 16 pages.
English-language abstract for WO 94/19653 (Tatarinov).
http://www.vortexair.biz/cooling/spotcoolprod/spotcoolprod.htm, printed Mar. 17, 2009, 3 pages.
http://www.vortexair.biz/cooling/coldairgun/coldairgun.html, printed Mar. 17, 2009, 3 pages.
http://www.universal-vortex.com/home/tabid/73/default.aspx, printed Mar. 17, 2009, 4 pages.
http://www.cficinc.com/index.php?id=42, printed Mar. 17, 2009, 2 pages.
http://www.exair.com/en-US/Primary%20navigation/products/vortex%20tubes%20and%20spot%20cooling/pages/vortex%20tubestubes%20and%20spot%20cooling%20home.aspx, printed Mar. 17, 2009, 2 pages.
http://en.wikipedia.org/wiki/vortex_tube, printed Mar. 17, 2009, 3 pages.

* cited by examiner

ENERGY TRANSFER APPARATUS AND METHODS

RELATED APPLICATIONS

This application claims priority to U.S. patent application Ser. Nos. 11/937,569, filed on Nov. 9, 2007, the entire contents of which are incorporated herein by reference, and 60/942,401, filed on Jun. 6, 2007.

FIELD OF THE INVENTION

The present invention relates to energy transfer apparatuses and methods. More specifically, the invention relates to an energy transfer apparatus, such as an energy transfer tube in which rotating flow is established, having a cold-fluid-discharge end and a hot-fluid-discharge end. Methods of using such an apparatus are also provided, as are various systems incorporating one or more such apparatuses.

BACKGROUND OF THE INVENTION

FIG. 1 of U.S. Patent Application Publication No. 2006/0150643 shows a vortex tube. Vortex tubes have been used in some commercial applications, such as spot cooling. However, their use has been limited. This is because vortex tubes have not been able to produce cold fluid efficiently enough to gain widespread commercial acceptance.

The energy transfer tube disclosed in U.S. Patent Application Publication No. 2006/0150643 fixes the efficiency problems that have plagued vortex tubes. The inventor has now surprisingly discovered, through extensive experimentation, that superior performance can be achieved by providing an energy transfer tube with multiple fluid flow generators. The multiple fluid flow generators are provided to create multiple fluid flows inside the tube. More will be said of this later.

SUMMARY

In certain embodiments, the invention provides an apparatus for transferring energy by rotating fluid within the apparatus. The apparatus has a cold-fluid-discharge end and a hot-fluid-discharge end. In the present embodiments, the apparatus includes an energy transfer chamber (optionally bounded by an energy transfer tube) and first and second fluid flow generators. The first and second generators are each adapted to create a rotating fluid flow at least part of which is located in the energy transfer chamber (optionally inside an energy transfer tube). In the present embodiments, both generators are adjacent to the cold-fluid-discharge end, and the second generator is closer to the cold-fluid-discharge end than is the first generator. The cold-fluid-discharge end comprises a cold fluid outlet, and the hot-fluid-discharge end comprises one or more hot fluid ports.

In some of the present embodiments, the first and second generators are side-by-side.

In certain cases, the first generator includes a passage configured to deliver pressurized fluid into a first fluid flow chamber so as to create a rotating flow in the first fluid flow chamber. The rotating flow created in the first fluid flow chamber is defined as the first rotating flow. Similarly, the second generator can include a passage configured to deliver pressurized fluid into a second fluid flow chamber so as to create a rotating flow in the second fluid flow chamber. The rotating flow created in the second fluid flow chamber is defined as the second rotating flow. Optionally, the first generator can surround the first fluid flow chamber and have a plurality of circumferentially spaced passages configured to deliver pressurized fluid into the first fluid flow chamber. Similarly, the second generator can optionally surround the second fluid flow chamber and have a plurality of circumferentially spaced passages configured to deliver pressurized fluid into the second fluid flow chamber. When provided, the energy transfer tube can optionally have first and second ends, and this tube can be in fluid communication with the first and second fluid flow chambers such that the first and second rotating flows extend respectively from the first and second fluid flow chambers, into the energy transfer tube, and toward the second end of the tube. In some cases, one or more hot-fluid ports are adjacent to the second end of the tube, and some fluid from the second rotating flow escapes through the hot-fluid port(s), while a major portion of the second rotating flow, and at least a major portion of the first rotating flow, return back through the tube toward its first end and escape through the cold-fluid outlet.

An optional flow-delivery passage can extend between first and second fluid flow chambers of the apparatus, and an energy transfer tube, the first fluid flow chamber, the flow-delivery passage, and the second fluid flow chamber can all be coaxial to one another. In some cases, a first extension tube defines a passage from the first generator to the energy transfer tube, and the first extension tube has an internal diameter that is smaller than an internal diameter of a flow-delivery passage between the first and second fluid flow chambers. In other cases, the first extension tube is omitted, and the energy transfer tube has an internal diameter that is smaller than an internal diameter of a flow-delivery passage between the first and second fluid flow chambers. If desired, a second extension tube can be provided so as to extend from the second generator toward the cold-fluid outlet. When provided, the second extension tube can optionally have an internal diameter adjacent to the second generator that is smaller than the internal diameter of a flow-delivery passage between the first and second fluid flow chambers.

In some of the present embodiments, the hot-fluid-discharge end of the apparatus is partially closed by a structure comprising a flow-blocking wall, and the flow-blocking wall is located radially inwardly from a plurality of hot-fluid ports.

Optionally, the apparatus includes one or more inlet devices adapted to deliver pressurized fluid into first and second inlet chambers, and the first generator includes a passage configured to receive pressurized fluid from a first inlet chamber and deliver that pressurized fluid into a first fluid flow chamber so as to create a rotating flow in the first fluid flow chamber. In such cases, the rotating flow created in the first fluid flow chamber is defined as the first rotating flow. Similarly, the second generator can include a passage configured to receive pressurized fluid from a second inlet chamber and deliver that pressurized fluid into a second fluid flow chamber so as to create a rotating flow in the second fluid flow chamber. In such cases, the rotating flow created in the second fluid flow chamber is defined as the second rotating flow. When provided, the inlet device(s) can optionally define separate first and second inlet paths such that a first supply flow at one pressure can be delivered to the first inlet chamber while a second supply flow at a different pressure can be delivered simultaneously to the second inlet chamber. The first inlet chamber can, for example, have an annular configuration, and the inlet device(s) can optionally have a first inlet passage through which pressurized fluid is adapted to flow when being delivered to the first inlet chamber. The first inlet passage can advantageously be oblique to a radius of the first inlet chamber. Similarly, the second inlet chamber can have an annular configuration, the inlet device(s) can optionally have a second inlet passage through which pressurized fluid is adapted to flow when being delivered to the second inlet chamber, and the second inlet passage can advantageously be oblique to a radius of the second inlet chamber. The (or each) passage of the first generator can optionally lie in a plane inclined at an angle of at least one degree relative to a plane perpendicular to a central axis of the first fluid flow chamber, and the (or each) passage of the second generator can optionally lie in a plane inclined at an angle of at least one degree relative to a plane perpendicular to a central axis of the second fluid flow chamber. Additionally or alternatively, the (or each) passage of the first generator can optionally have a curved configuration in a cross section taken along a plane perpendicular the central axis of the first fluid flow chamber, and the (or each) passage of the second generator can optionally have a curved configuration in a cross section taken along a plane perpendicular the central axis of the second fluid flow chamber.

In some of the present embodiments, the apparatus is adapted to produce a stream of cold fluid from the cold-fluid-discharge end while simultaneously producing a stream of hot fluid from the hot-fluid-discharge end, and the stream of cold fluid has a cold-end outlet temperature that can be changed by performing a clutching step. In these embodiments, the clutching step can involve simultaneously maintaining a first inlet pressure at a substantially constant level while changing a second inlet pressure. The first inlet pressure is the pressure at which pressurized fluid is delivered to a first generator of the apparatus, and the second inlet pressure is the pressure at which pressurized fluid is delivered to a second generator of the apparatus.

In some of the foregoing apparatus embodiments, the fluid flow generators are collectively adapted to create at least eight fluid flow layers extending through the energy transfer chamber (optionally extending through an energy transfer tube). Here, the fluid flow layers are counted as found in a cross section taken along a plane lying on a central axis of the energy transfer chamber (optionally lying on a central axis of an energy transfer tube), and each of the eight fluid flow layers extends along at least a major length of the energy transfer chamber (optionally along a major length of an energy transfer tube).

In certain embodiments, the invention provides a method for generating a flow of cold fluid. The method involves an apparatus for transferring energy by rotating fluid within the apparatus. The apparatus has a cold-fluid-discharge end and a hot-fluid-discharge end. The apparatus includes an energy transfer chamber (optionally bounded by an energy transfer tube) and first and second fluid flow generators. In the present embodiments, both generators are adjacent to the cold-fluid-discharge end, and the second generator is closer to the cold-fluid-discharge end than is the first generator. The cold-fluid-discharge end comprises a cold fluid outlet, and the hot-fluid-discharge end comprises one or more hot fluid ports. The present method comprises delivering pressurized fluid from the first and second generators into first and second fluid flow chambers of the apparatus so as to create first and second rotating flows, which then extend respectively from the first and second fluid flow chambers into the energy transfer chamber (optionally into an energy transfer tube) and toward the hot-fluid-discharge end of the apparatus, resulting in some fluid from the second rotating flow escaping through the hot-fluid port(s) while a major portion of the second rotating flow, and at least a major portion of the first rotating flow, return back through the energy transfer chamber (optionally through an energy transfer tube) tube toward the cold-fluid-discharge end and escape through the cold-fluid outlet.

In some of the present embodiments, the method involves beginning operation of the apparatus by starting pressurized fluid flow through the first generator before starting pressurized fluid flow through the second generator. For example, in certain embodiments, the pressurized fluid flow through the second generator is started after: i) pressurized fluid flow through the first generator has been started, and ii) an acoustic tone has been generated in the apparatus.

Some of the present embodiments involve the first generator receiving pressurized fluid that is delivered into the apparatus at a first inlet pressure of about 115 psi or less.

The present method can optionally involve the first generator receiving pressurized fluid that is delivered into the apparatus at a first inlet pressure while simultaneously the second generator receives pressurized fluid that is delivered into the apparatus at a second inlet pressure. In such cases, the first and second inlet pressures are different. For example, the second inlet pressure can optionally be greater than the first inlet pressure by at least 2 psi, by at least 5 psi, by at least 10 psi, or even by at least 15 psi.

In some of the present method embodiments, the first and second generators are non-moving so as to remain stationary during operation of the apparatus.

In some cases, the pressurized fluid delivered from the first and second generators into the first and second fluid flow chambers comprises at least one fluid selected from the group consisting of air, inert gas, and water.

When provided, the energy transfer tube can optionally bound a generally cylindrical interior space that forms at least part of the energy transfer chamber, and operation of the apparatus can produce a stream of cold fluid from the cold-fluid-discharge end while simultaneously producing a stream of hot fluid from the hot-fluid-discharge end. The stream of cold fluid will be at a lower temperature than pressurized fluid delivered into the apparatus, and the stream of hot fluid will be at a higher temperature than pressurized fluid delivered into the apparatus.

In some of the present embodiments, the fluid flow generators of the apparatus are operated so as to collectively create at least eight fluid flow layers extending through the energy transfer chamber (optionally extending through an energy transfer tube bounding such chamber). The fluid flow layers here are counted as found in a cross section taken along a plane lying on a central axis of the energy transfer chamber (e.g., on a central axis of an energy transfer tube). Preferably, each of these eight fluid flow layers extends along at least a major length of the energy transfer chamber (optionally along a major length of an energy transfer tube).

In certain embodiments, the invention provides an apparatus for transferring energy by rotating fluid within the apparatus. Preferably, the apparatus has a cold-fluid-discharge end and a hot-fluid-discharge end, and the cold-fluid-discharge end comprises a cold fluid outlet while the hot-fluid-discharge end comprises one or more hot fluid ports. The apparatus includes an energy transfer chamber (optionally bounded by an energy transfer tube) and a plurality of fluid flow generators. In the present embodiments, the fluid flow generators are collectively adapted to create at least eight fluid flow layers extending through the energy transfer chamber (optionally extending through an energy transfer tube). Here, the fluid flow layers are counted as found in a cross section taken along a plane lying on a central axis of the energy transfer chamber (e.g., lying on a central axis of an optional energy transfer tube). Each of these eight fluid flow layers extends along at least a major length of the energy transfer chamber (optionally along a major length of an energy transfer tube).

In some cases, the plurality of generators includes first and second generators both located adjacent to the cold-fluid-discharge end of the apparatus, with the second generator being closer to the cold-fluid-discharge end than is the first generator.

In some of the present embodiments, the apparatus includes first and second generators that are positioned (e.g., mounted or otherwise disposed) side-by-side.

In certain cases, a first generator includes a passage configured to deliver pressurized fluid into a first fluid flow chamber so as to create a rotating flow in the first fluid flow chamber. The rotating flow created in the first fluid flow chamber is defined as the first rotating flow. Similarly, a second generator can include a passage configured to deliver pressurized fluid into a second fluid flow chamber so as to create a rotating flow in the second fluid flow chamber. The rotating flow created in the second fluid flow chamber is defined as the second rotating flow. Optionally, the first generator can surround the first fluid flow chamber and have a plurality of circumferentially spaced passages configured to deliver pressurized fluid into the first fluid flow chamber. Similarly, the second generator can optionally surround the second fluid flow chamber and have a plurality of circumferentially spaced passages configured to deliver pressurized fluid into the second fluid flow chamber. When provided, the energy transfer tube can optionally have first and second ends, and this tube can be in fluid communication with the first and second fluid flow chambers such that first and second rotating flows extend respectively from the first and second fluid flow chambers, into the energy transfer tube, and toward the second end of the tube. In some cases, one or more hot-fluid ports are adjacent to the second end of the energy transfer tube, and some fluid from the second rotating flow escapes through the hot-fluid port(s), while a major portion of the second rotating flow, and at least a major portion of the first rotating flow, return back through the energy transfer tube toward its first end and escape through the cold-fluid outlet of the apparatus.

A flow-delivery passage can optionally extend between first and second fluid flow chambers of the apparatus, and an energy transfer tube, the first fluid flow chamber, the flow-delivery passage, and the second fluid flow chamber can all be coaxial to one another. In some cases, a first extension tube defines a passage from the first generator to the energy transfer tube, and the first extension tube has an internal diameter that is smaller than an internal diameter of a flow-delivery passage between the first and second fluid flow chambers. In other cases, the first extension tube is omitted, and the energy transfer tube has an internal diameter that is smaller than an internal diameter of the flow-delivery passage between the first and second fluid flow chambers. If desired, a second extension tube can be provided so as to extend from the second generator toward the cold-fluid outlet. When provided, the second extension tube can optionally have an internal diameter adjacent to the second generator that is smaller than the internal diameter of the flow-delivery passage between the first and second fluid flow chambers.

In some of the present embodiments, the hot-fluid-discharge end of the apparatus is partially closed by a structure comprising a flow-blocking wall, and the flow-blocking wall is located radially inwardly from a plurality of hot-fluid ports.

Optionally, the apparatus includes one or more inlet devices adapted to deliver pressurized fluid into first and second inlet chambers, and a first generator includes a passage configured to receive pressurized fluid from the first inlet chamber and deliver that pressurized fluid into a first fluid flow chamber so as to create a rotating flow in the first fluid flow chamber. In such cases, the rotating flow created in the first fluid flow chamber is defined as the first rotating flow. Similarly, a second generator can include a passage configured to receive pressurized fluid from the second inlet chamber and deliver that pressurized fluid into a second fluid flow chamber so as to create a rotating flow in the second fluid flow chamber. In such cases, the rotating flow created in the second fluid flow chamber is defined as the second rotating flow. When provided, the inlet device(s) can optionally define separate first and second inlet paths such that a first supply flow at one pressure can be delivered to the first inlet chamber while a second supply flow at a different pressure can be delivered simultaneously to the second inlet chamber. The first inlet chamber can, for example, have an annular configuration, and the inlet device(s) can optionally have a first inlet passage through which pressurized fluid is adapted to flow when being delivered to the first inlet chamber. The first inlet passage can advantageously be oblique to a radius of the first inlet chamber. Similarly, the second inlet chamber can have an annular configuration, the inlet device(s) can optionally have a second inlet passage through which pressurized fluid is adapted to flow when being delivered to the second inlet chamber, and the second inlet passage can advantageously be oblique to a radius of the second inlet chamber. The (or each) passage of the first generator can optionally lie in a plane inclined at an angle of at least one degree relative to a plane perpendicular to a central axis of the first fluid flow chamber, and the (or each) passage of the second generator can optionally lie in a plane inclined at an angle of at least one degree relative to a plane perpendicular to a central axis of the second fluid flow chamber. Additionally or alternatively, the (or each) passage of the first generator can optionally have a curved configuration in a cross section taken along a plane perpendicular the central axis of the first fluid flow chamber, and the (or each) passage of the second generator can optionally have a curved configuration in a cross section taken along a plane perpendicular the central axis of the second fluid flow chamber.

In some of the present embodiments, the apparatus is adapted to produce a stream of cold fluid from the cold-fluid-discharge end while simultaneously producing a stream of hot fluid from the hot-fluid-discharge end, and the stream of cold fluid has a cold-end outlet temperature that can be changed by performing a clutching step. In these embodiments, the clutching step can optionally involve simultaneously maintaining a first inlet pressure at a substantially constant level while changing a second inlet pressure. The first inlet pressure is the pressure at which pressurized fluid is delivered to a first generator, and the second inlet pressure is the pressure at which pressurized fluid is delivered to a second generator.

In certain embodiments, the invention provides a method for generating a flow of cold fluid. The method involves an apparatus for transferring energy by rotating fluid within the apparatus. Preferably, the apparatus has a cold-fluid-discharge end and a hot-fluid-discharge end, the cold-fluid-discharge end comprises a cold fluid outlet, and the hot-fluid-discharge end comprises one or more hot fluid ports. In the present method, the apparatus includes an energy transfer chamber (optionally bounded by an energy transfer tube) and a plurality of fluid flow generators. The fluid flow generators are operated so as to collectively create at least eight fluid flow layers extending through the energy transfer chamber (optionally extending through an energy transfer tube bounding such chamber). The fluid flow layers here are counted as found in a cross section taken along a plane lying on a central axis of the energy transfer chamber (optionally on a central axis of an energy transfer tube). Preferably, each of these eight fluid flow layers extends along at least a major length of the energy transfer chamber (optionally along a major length of an energy transfer tube).

In some of the present embodiments, the method results in a stream of cold fluid flowing from the cold-fluid-discharge end while simultaneously a stream of hot fluid flows from the hot-fluid-discharge end. The stream of cold fluid, in some of these embodiments, is at a temperature that is at least 200 degrees Fahrenheit lower than the temperature of the stream of hot fluid.

In some cases, the present method involves beginning operation of the apparatus by starting pressurized fluid flow through a first generator of the apparatus before starting pressurized fluid flow through a second generator of the apparatus. For example, in certain embodiments, the pressurized fluid flow through a second generator is started after: i) pressurized fluid flow through a first generator has been started, and ii) an acoustic tone has been generated in the apparatus.

Some of the present embodiments involve a first generator of the apparatus receiving pressurized fluid that is delivered into the apparatus at a first inlet pressure of about 115 psi or less.

The present method can optionally involve a first generator of the apparatus receiving pressurized fluid that is delivered into the apparatus at a first inlet pressure while simultaneously a second generator of the apparatus receives pressurized fluid that is delivered into the apparatus at a second inlet pressure. In such cases, the first and second inlet pressures are different. For example, the second inlet pressure can optionally be greater than the first inlet pressure by at least 2 psi, by at least 5 psi, by at least 10 psi, or even by at least 15 psi.

In some of the present method embodiments, the apparatus includes first and second generators that are non-moving so as to remain stationary during operation of the apparatus.

In some cases, the method involves pressurized fluid being delivered from first and second generators of the apparatus into first and second fluid flow chambers of the apparatus, and the working fluid comprises at least one fluid selected from the group consisting of air, inert gas, and water.

When provided, the energy transfer tube can optionally bound a generally cylindrical interior space that forms at least part of the energy transfer chamber, and operation of the apparatus can produce a stream of cold fluid from the cold-fluid-discharge end while simultaneously producing a stream of hot fluid from the hot-fluid-discharge end. The stream of cold fluid will be at a lower temperature than pressurized fluid delivered into the apparatus, and the stream of hot fluid will be at a higher temperature than pressurized fluid delivered into the apparatus.

Certain embodiments provide an apparatus for transferring energy by rotating fluid within the apparatus. The apparatus has a cold-fluid-discharge end and a hot-fluid-discharge end. The apparatus includes an energy transfer tube and first and second fluid flow generators. The first and second generators are each adapted to create a rotating fluid flow at least part of which is located inside the energy transfer tube. Preferably, both generators are adjacent to the cold-fluid-discharge end. The second generator is closer to the cold-fluid-discharge end than is the first generator. The cold-fluid-discharge end comprises a cold fluid outlet, and the hot-fluid-discharge end comprises one or more hot fluid ports. In the present embodiments, the apparatus is adapted to provide single-phase gaseous flow through two inlet passages leading respectively to the first and second generators.

Certain embodiments provide a method of operating an apparatus adapted to transfer energy by rotating fluid within the apparatus. The apparatus has a cold-fluid-discharge end and a hot-fluid-discharge end. The apparatus includes an energy transfer tube and first and second fluid flow generators. Preferably, both generators are adjacent to the cold-fluid-discharge end. The second generator is closer to the cold-fluid-discharge end than is the first generator. The cold-fluid-discharge end comprises a cold fluid outlet, and the hot-fluid-discharge end comprises one or more hot fluid ports. The method comprises delivering pressurized fluid from the first and second generators into first and second fluid flow chambers of the apparatus so as to create first and second rotating flows, which then extend respectively from the first and second fluid flow chambers through the energy transfer tube toward the hot-fluid-discharge end of the apparatus, resulting in some fluid from the second rotating flow escaping through the hot-fluid port(s) while a major portion of the second rotating flow, and at least a major portion of the first rotating flow, return back through the energy transfer tube toward the cold-fluid-discharge end and escape through the cold-fluid outlet. The apparatus includes first and second inlet passages leading respectively to the first and second generators. In the present embodiments, the method comprises delivering single-phase gaseous flow to both of the inlet passages.

In certain embodiments, the invention provides a method of operating an apparatus adapted to transfer energy by rotating fluid within the apparatus. The apparatus has a cold-fluid-discharge end and a hot-fluid-discharge end. The apparatus includes an energy transfer tube and first and second fluid flow generators. Preferably, both generators are adjacent to the cold-fluid-discharge end, and the second generator is closer to the cold-fluid-discharge end than is the first generator. The cold-fluid-discharge end comprises a cold fluid outlet, and the hot-fluid-discharge end comprises one or more hot fluid ports. The method comprises delivering pressurized fluid from the first and second generators into first and second fluid flow chambers of the apparatus so as to create first and second rotating flows that then extend respectively from the first and second fluid flow chambers through the energy transfer tube toward the hot-fluid-discharge end of the apparatus, resulting in some fluid from the second rotating flow escaping through the hot-fluid port(s) while a major portion of the second rotating flow, and at least a major portion of the first rotating flow, return back through the energy transfer tube toward the cold-fluid-discharge end and escape through the cold-fluid outlet. The apparatus includes first and second inlet passages leading respectively to the first and second generators. In the present embodiments, the method comprises delivering a first inflow through the first inlet passage and delivering a second inflow through the second inlet passage, and the first and second inflows are provided by delivering fluid of substantially the same chemical composition to both the first and second inlet passages.

Certain embodiments provide a method of operating an apparatus adapted to transfer energy by rotating fluid within the apparatus. The apparatus has a cold-fluid-discharge end and a hot-fluid-discharge end. The apparatus includes an energy transfer tube and first and second fluid flow generators. Preferably, both generators are adjacent to the cold-fluid-discharge end, and the second generator is closer to the cold-fluid-discharge end than is the first generator. The cold-fluid-discharge end comprises a cold fluid outlet, and the hot-fluid-discharge end comprises one or more hot fluid ports. The method comprises delivering pressurized fluid from the first and second generators into first and second fluid flow chambers of the apparatus so as to create first and second rotating flows that then extend respectively from the first and second fluid flow chambers through the energy transfer tube toward the hot-fluid-discharge end of the apparatus, resulting in some fluid from the second rotating flow escaping through the hot-fluid port(s) while a major portion of the second rotating flow, and at least a major portion of the first rotating flow, return back through the energy transfer tube toward the cold-fluid-discharge end and escape through the cold-fluid outlet. The apparatus includes first and second inlet passages leading respectively to the first and second generators. In the present embodiments, the method comprises delivering a first inflow through the first inlet passage and delivering a second inflow through the second inlet passage. In some of the present embodiments, the second inflow has a flow rate that is different than, but no more than 50% greater or less than, that of the first inflow.

In any embodiment mentioned in this disclosure, the cold fluid outlet can optionally have an outflow temperature that can be adjusted by adjusting a pressure of fluid delivered to one of the two generators, defined as a clutching generator, while holding constant a pressure of fluid delivered to the other of the two generators. In some such cases, the rotating fluid flow created by the clutching generator is an outermost rotating flow, which is located closer to an inside wall of the energy transfer tube than is the rotating fluid flow created by the other of the two generators.

Any embodiment mentioned in this disclosure can optionally have one or more of the following features: 1) a flow-delivery passage extending between first and second fluid flow chambers, wherein the first and second fluid flow chambers have internal diameters larger than an internal diameter of the flow-delivery passage, 2) a flow-delivery passage extending between first and second fluid flow chambers, wherein the flow-delivery passage has an internal diameter larger than an internal diameter of the energy transfer tube, 3) an extension tube extending from the second generator toward the cold-fluid outlet, wherein the extension tube has an internal diameter (adjacent to the second generator) that is smaller than an internal diameter of a flow-delivery passage between first and second fluid flow chambers, 4) the rotating fluid flow created by the second generator is an outermost rotating flow, which is located closer to an inside wall of the energy transfer tube than is the rotating fluid flow created by the first generator, 5) the second generator is run at a higher pressure than the first generator (e.g., the second generator receives a supply of fluid at a higher pressure than the supply of fluid received by the first generator). In some cases, the apparatus has all five of these features, any one of these features, any two of these features, any three of these features, or any four of these features.

DETAILED DESCRIPTION OF PREFERRED EMBODIMENTS

The following detailed description is to be read with reference to the drawings, in which like elements in different drawings have like reference numbers. The drawings, which are not necessarily to scale, depict selected embodiments and are not intended to limit the scope of the invention. Skilled artisans will recognize that the given examples have many alternatives that fall within the scope of the invention.

Figure 1:
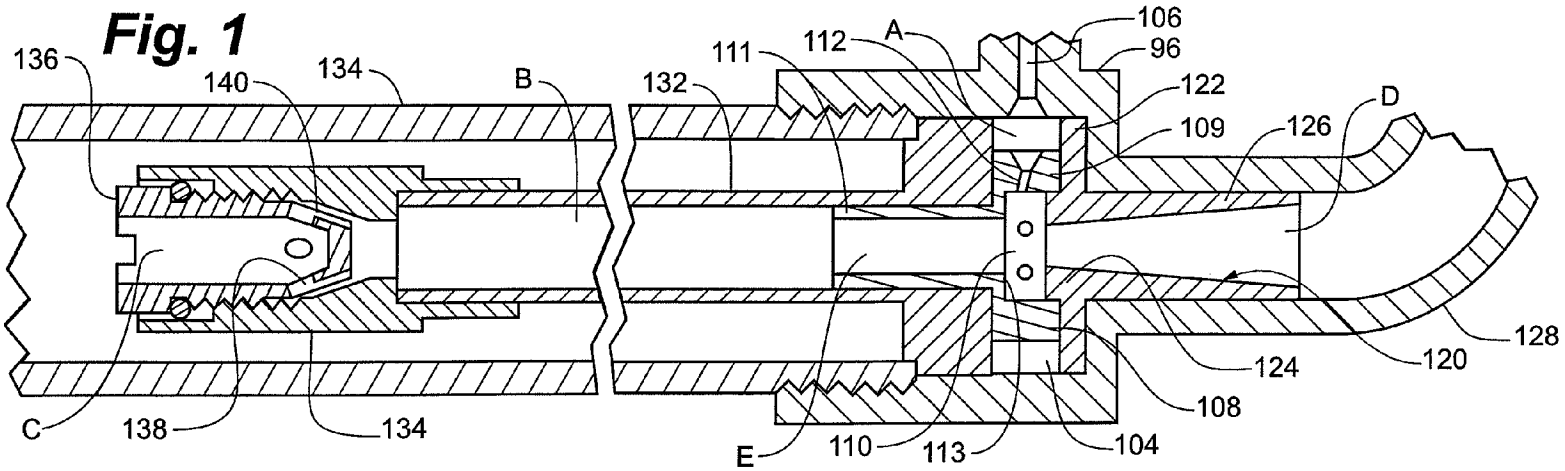
FIG. 1 is a sectional view of an energy transfer tube with a single fluid flow generator.

Referring to FIG. 1, U.S. patent application Ser. No. 11/198,617 ("the '617 application") discloses an energy transfer tube provided at one end with a flow generator 108 that induces a helical flow in the energy transfer tube. An outer flow passes from the chamber 110 through the extension tube 111 and through the energy transfer tube 132. In FIG. 1, part of the outer flow escapes through the grooves 140 and passages 138 of a throttle valve 136 and flows to atmosphere through a muffler, but a relatively large portion returns through the tube 132 in a revolving inner flow and leaves through the extension tube 126 and the outlet tube 128. With the energy transfer tube described in the '617 application, performance is superior when an acoustic vibration exists in the vicinity of the opening from the passages 112 into the chamber 110. Performance can be particularly good when an acoustic vibration exists over substantially the entire length of the energy transfer tube.

Figure 2:
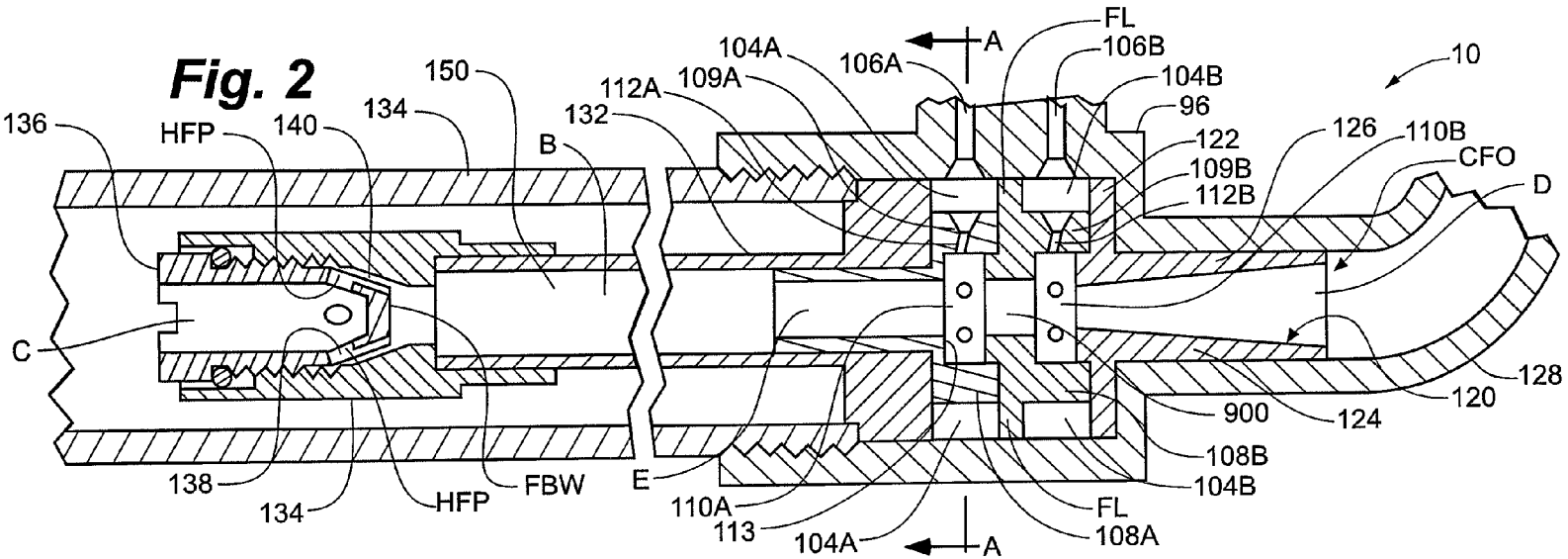
FIG. 2 is a sectional view of an energy transfer apparatus having a plurality of fluid flow generators in accordance with the present invention.

It has been discovered through extensive experimentation that superior performance can be obtained by providing an energy transfer apparatus (e.g., an apparatus comprising an energy transfer tube) with multiple fluid flow generators. FIG. 2 shows, by way of example, an energy transfer apparatus equipped with two fluid flow generators. (If desired, the first fluid flow generator 108A can be essentially the same as the flow generator 108 shown in FIG. 1.) In FIG. 2, the first fluid flow generator 108A includes one or more passages (preferably a plurality of passages) 112A that deliver fluid under pressure from the first inlet chamber 104A to the first fluid flow chamber 110A. The second fluid flow generator 108B can be similar, e.g., it can have one or more passages 112B that deliver fluid under pressure from a second inlet chamber 104B to a second fluid flow chamber 110B. In FIG. 2, the second generator 108B has an annular boss that fits in chamber 110A. In the illustrated embodiment, this flow generator 108B has an external flange FL that separates the two illustrated inlet chambers 104A, 104B. The inlet chambers can alternatively be separated by other structural means. For example, the illustrated flange could extend inwardly from the inlet device 96, rather than being part of the second generator. Many other configurations could be used as well. Thus, in some embodiments, separate first and second inlet passages 106A, 106B supply compressed fluid to first and second inlet chambers 104A and 104B respectively. In FIG. 2, the annular boss 124 of structure 120 (which can optionally be a molded structure) fits in chamber 110B (which is cylindrical in the embodiment shown). This design feature, however, is strictly optional.

Figure 6:
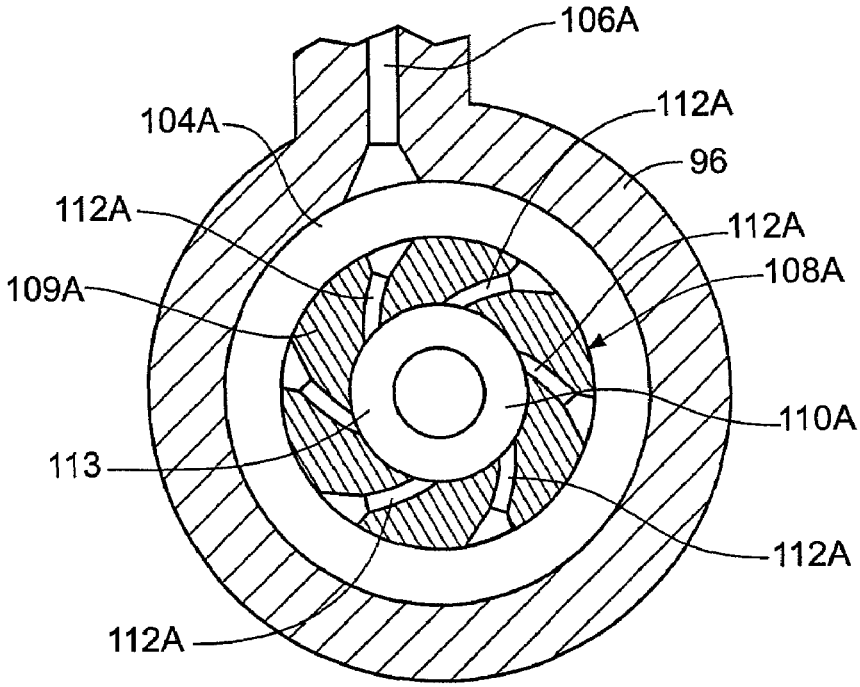
FIG. 6 is a sectional view, taken along lines A-A in FIGS. 2-4, of a first fluid flow generator for an energy transfer apparatus in accordance with certain embodiments of the invention.
Figure 7A:
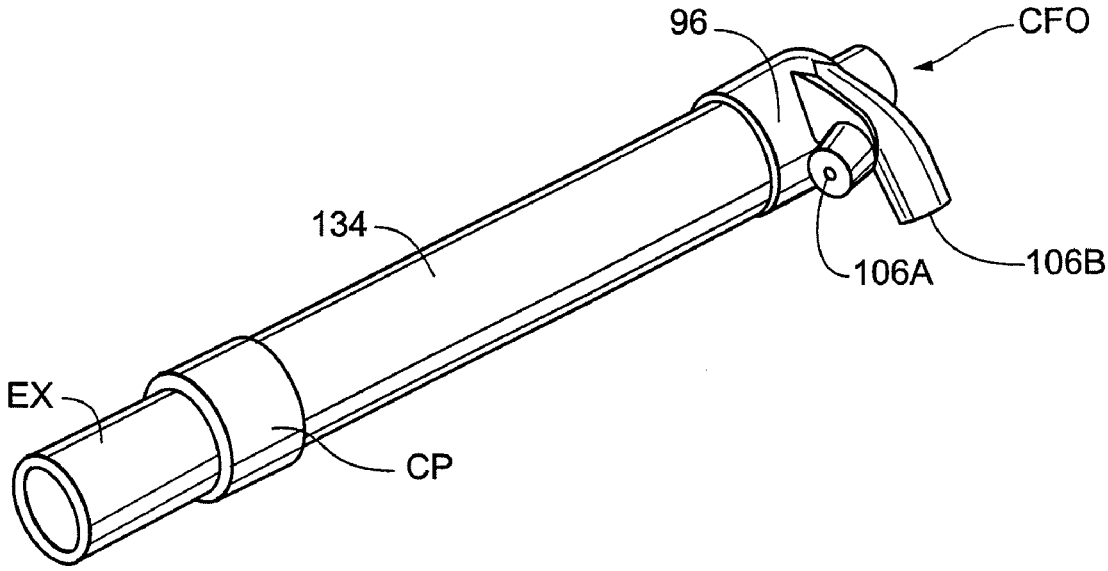
FIG. 7A is a perspective view of an energy transfer apparatus in accordance with certain embodiments of the invention.
Figure 7B:
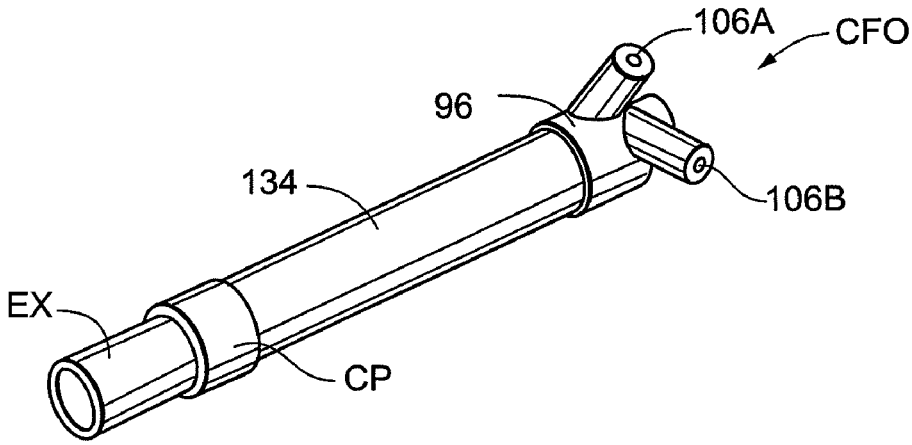
FIG. 7B is a perspective view of another energy transfer apparatus in accordance with certain embodiments of the invention.
Figure 13:
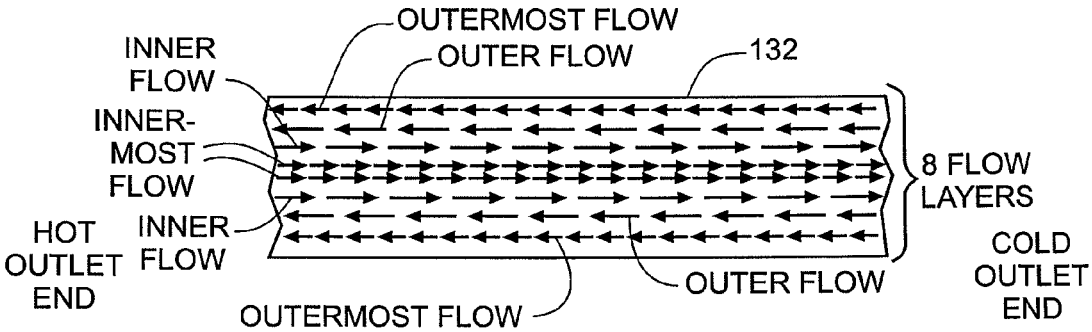
FIG. 13 is a cross-sectional view of an energy transfer tube, schematically depicting eight fluid flow layers in the tube in accordance with certain embodiments of the invention.

With continued reference to FIG. 2, fluid under pressure is supplied through the first inlet passage 106A, enters the first inlet chamber 104A, and creates a rotating flow in that chamber (rotating in a counterclockwise direction as seen in a cross-section taken along lines A-A, see FIG. 6). Fluid flows from the first inlet chamber 104A through passages 112A into the first fluid flow chamber 110A, creating a revolving outer flow that passes through the extension tube 111 and the energy transfer tube 132. Part of the outer flow may escape through the grooves 140 and passages 138 of the illustrated throttle valve 136, but a relatively large proportion of the fluid returns from the far end back through the tube 132 in a revolving inner flow and leaves through the extension tube 126 and the outlet tube 128. Operation is similar for the second fluid flow generator 108B shown in FIG. 2-*a* revolving outermost flow created in the second fluid flow chamber 110B passes through the first fluid flow chamber 110A (after passing through an optional flow-delivery passage 900 between the first and second flow chambers 110A, 110B) and then passes through extension tube 111 and energy transfer tube 132. Some of the outermost flow escapes through the passages of the illustrated throttle valve, but most of this flow returns back through the tube in a revolving innermost flow, and then leaves through extension tube 126 and outlet tube 128. Thus, the "inner" flow is located radially between the "innermost" flow and the "outer" flow, the "outer" flow is located radially between the "inner" flow and the "outermost" flow, and the "outermost" flow is located radially between the "outer" flow and the wall of the tube. Reference is made to FIG. 13. There may be some mixing between the first flow (which includes the outer and inner flows) and the second flow (which includes the outermost and innermost flows). Accordingly, some fluid from both flows may escape through the passages 138 of the illustrated throttle valve 136, then flowing to atmosphere, e.g., through a muffler or "exhaust member." The throttle valve and muffler or exhaust member are among a group of features that are not required, but rather are optional.

The direction of rotation of the second flow may be the same as that of the first flow. Or, it may be opposite to that of the first flow. Furthermore, in embodiments like that of FIG. 2, the pressure at which fluid is provided to the second inlet chamber 104B can be the same as, or different from, the pressure at which fluid is provided to the first inlet chamber 104A. Also, the entry angle of passage(s) 112B may, but need not, be the same as that of passage(s) 112A.

In certain embodiments, during operation, an acoustic vibration is generated spontaneously (in some cases, over substantially the entire length of an energy transfer tube of the apparatus). In other embodiments, to induce an acoustic vibration, it may be desirable to provide the apparatus with a transducer (e.g., by placing a transducer in, or on, an energy transfer tube of the apparatus). It is believed that energy flows at an accelerated rate in the apparatus when the acoustic tone is provided. The multiple-generator embodiments of the invention, however, are not strictly required to exhibit an acoustic vibration. Rather, the invention encompasses embodiments where the apparatus is provided with multiple generators but does not exhibit an acoustic vibration.

For embodiments where the apparatus 10 exhibits acoustic toning, this acoustic event is characterized by an acoustic frequency and amplitude propagating throughout a plurality of fluid flows (e.g., preferably propagating throughout all the fluid flows). This is contrary to acoustic streaming, in which an acoustic stream is isolated (or "localized") between two adjacent fluid flows. Thus, in acoustic toning, the acoustic tone propagates over a plurality (preferably over all) of the flow layers, rather than being trapped between two adjacent flow layers, as is the case with acoustic streaming. With reference to FIG. 13, it will be appreciated that an acoustic tone can propagate throughout (i.e., "over" or "across") all eight of the illustrated flow layers. As noted above, the acoustic tone can desirably exist over substantially the entire length of the energy transfer tube, although this is not strictly required.

In some cases, the acoustic tone has a frequency of greater than 1 kHz, such as between about 1 kHz and about 20 kHz. The frequency may be greater than 1.5 kHz, such as between 1.5 kHz and 5 kHz. It is to be appreciated, though, that the present invention is not limited to embodiments where an acoustic tone exists, much less to any particular frequency range.

Frequency measurements can be made, for example, using an Extech Model 407790 Octave Band Sound Analyzer (type 2 meter) and a Norsonic Model 110 real time sound meter.

The foregoing description focuses on embodiments where the apparatus 10 comprises a cylindrical energy transfer tube 132. Here, the tube 132 bounds an energy transfer chamber 150 comprising a generally cylindrical interior space. In one practical embodiment, the energy transfer tube has a diameter of about ¼ inch (the length of this tube may be, for example, about ⅘ inches). In another practical embodiment, the diameter is about ⅜ inch (the length of this tube may be, for example, about seven inches). In yet another practical embodiment, the diameter is about ¾ inch (the length of this tube may be, for example, about 18 inches). Thus, the energy transfer tube 132 can be scaled. One group of embodiments involves a tube with a diameter in the range of between about 1/16 inch and about 2 inches, such as between about 1/8 inch and about 1 inch. This diameter range, however, is not limiting. For example, another practical embodiment involves a diameter of about 0.045 inch (the length of this tube may be, for example, about 1½ inches. Even smaller diameters are anticipated. Moreover, far larger diameters may be preferred for some applications.

The energy transfer tube 132 can optionally be cylindrical with a non-conical shape, as illustrated. This provides the energy transfer tube with desirable constant area/volume, which is advantageous for controlling pressure and frictional values so as to optimize energy transfer.

The energy transfer tube 132 can be formed of many different materials. Examples include stainless steel (such as AISI 304), brass, and other metals. Various non-metals may also be used. The invention is by no means limited to any particular material.

Figure 9A:
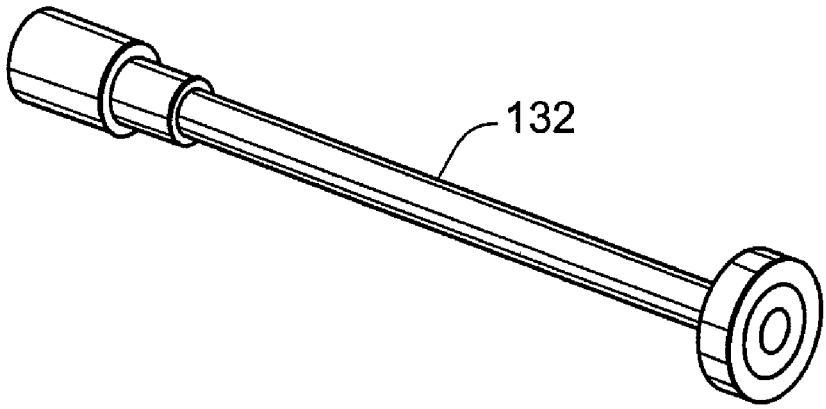
FIG. 9A is a perspective view of an energy transfer tube for an energy transfer apparatus in accordance with certain embodiments of the invention.
Figure 9B:
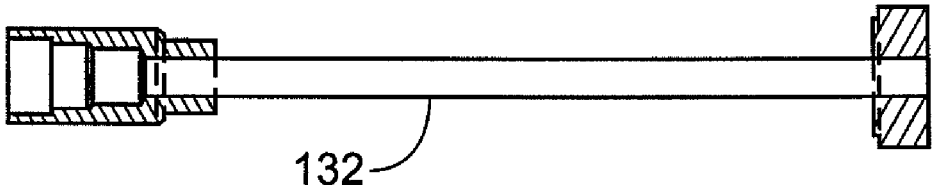
FIG. 9B is a cross-sectional view of the energy transfer tube of FIG. 9A.

Thus, the illustrated apparatus 10 includes an energy transfer tube 132. An exemplary design of one such tube is shown in FIGS. 9A and 9B. The tube, though, can be provided in many different forms. For example, it is not strictly required to be circular in cross section.

Many different types of fluid can be used in the energy transfer apparatus 10. In one group of embodiments, the working fluid comprises a fluid selected from the group consisting of air, inert gas, and water. When inert gas is used, argon, helium, or another noble gas may be desired. A fluid mixture comprising two or more inert gases may also be used. In some cases, the working fluid comprises steam. In other cases, it may be desirable to use methane, natural gas, etc. In some embodiments, the fluid flowing through the apparatus 10 includes at least some liquid and at least some gas. To obtain higher levels of friction (between the fluid flows) and heat transfer, it may be preferred to use fluid that comprises or consists essentially of gas. Thus, gas can optionally be flowed into both inlets/each inlet. In one group of embodiments, the fluid includes vapor, and the fluid is delivered into the apparatus at a particularly high pressure, e.g., about 175 psi or more.

In certain embodiments, the energy transfer apparatus 10 is adapted to receive single-phase gaseous flow. For example, the apparatus 10 can optionally be adapted to provide single-phase gaseous flow through two inlet passages 106A, 106B leading respectively to the first and second generators 108A, 108B. The inlet passages may be configured as shown. More generally, though, the inlet passages can be any passages, conduits, etc. through which fluid passes on the way to the first and second generators 108A, 108B. Thus, in some embodiments, the fluid delivered into the apparatus consists essentially of single-phase gaseous flow, rather than being two-phase flow.

Thus, the invention provides an energy transfer apparatus 10 having multiple fluid flow generators 108A, 108B. A few exemplary embodiments are shown in the figures. Here, the apparatus 10 has two fluid flow generators 108A, 108B. The inventor has discovered that having a second generator makes it possible to increase or decrease frictional properties of the flow inside the apparatus. This, in turn, allows the temperature of the cold fluid output to be adjusted (without changing the temperature of the fluid being fed into the apparatus).

Preferably, the apparatus 10 has a cold-fluid-discharge end and a hot-fluid-discharge end. Referring to FIGS. 2-4 and 12B, the cold-fluid-discharge end is on the right side (as seen in the drawing) and the hot-fluid-discharge end is on the left side (as seen in the drawing). It is to be understood that the terms "cold-fluid-discharge end" and "hot-fluid-discharge end" do not require any specific temperature separation. For example, the fluid flowing from the "cold" end could be considered cool rather than cold. Likewise, the fluid flowing from the "hot" end could be considered warm rather than hot. Preferably, the apparatus 10 makes it possible to readily adjust the temperature separation. For example, the temperature of fluid flowing from the cold-fluid-discharge end may be lower than the temperature of fluid flowing from the hot-fluid-discharge end by at least 100° F., by at least 200° F., by at least 300° F., or more. Smaller temperature differentials can be produced as well.

Figure 3:
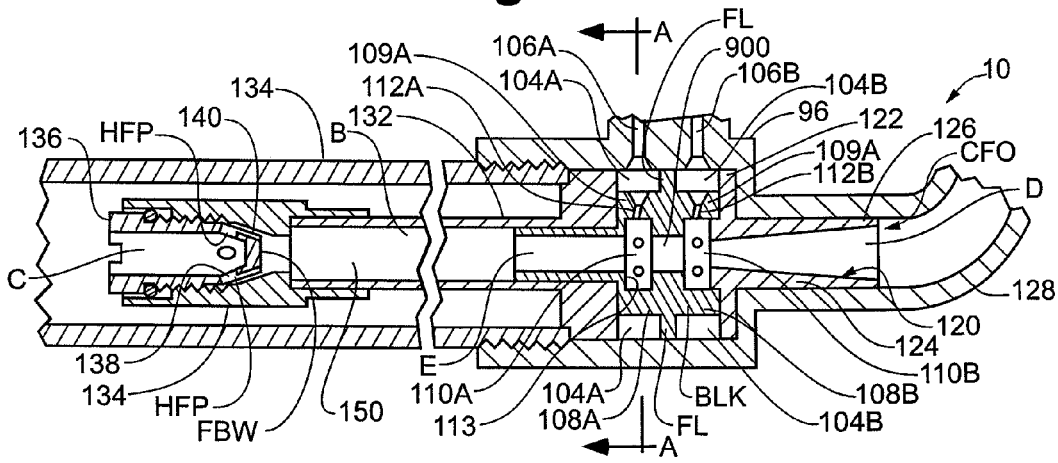
FIG. 3 is a sectional view of another energy transfer apparatus having a plurality of fluid flow generators in accordance with the present invention.
Figure 4:
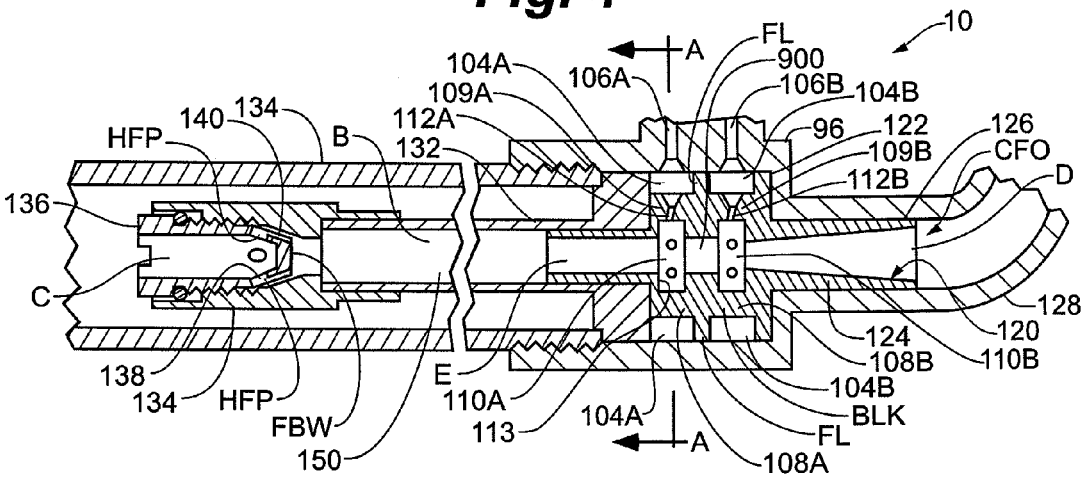
FIG. 4 is a sectional view of still another energy transfer apparatus having a plurality of fluid flow generators in accordance with the present invention.

In FIGS. 2-4, the cold and hot ends of the apparatus are shown as being opposed (e.g., at opposite ends of the apparatus). Thus, during operation of such an apparatus, respective hot and cold fluid streams emanate from opposed ends of the apparatus. This, however, may not be required in all embodiments.

Thus, some embodiments of the invention provide an apparatus 10 for transferring energy by rotating fluid within the apparatus. The apparatus 10 generally includes an energy transfer tube 132 and two fluid flow generators 108A, 108B. The first and second generators 108A, 108B are each adapted to create a rotating fluid flow at least part of which is inside the energy transfer tube 132. In some embodiments, both generators 108A, 108B are adjacent to the cold-fluid-discharge end of the apparatus. If desired, one or both of the generators can be located closer to (optionally past) the midpoint of the tube's length. For example, at least one generator could be closer to the hot-fluid-discharge end than to the cold-fluid-discharge end. Variants of this nature will be apparent to skilled artisans given the present teaching as a guide. In the illustrated embodiments, the second generator 108B is closer to the cold-fluid-discharge end than is the first generator 108A. The cold-fluid-discharge end has a cold fluid outlet CFO, and the hot-fluid-discharge end has one or more hot fluid ports HFP.

The first and second generators 108A, 108B can optionally be positioned side-by-side. In embodiments of this nature, the first and second generators 108A, 108B may be carried alongside each another (e.g., in direct contact with each other). Or, there may be an intermediate body separating them.

Figure 10:
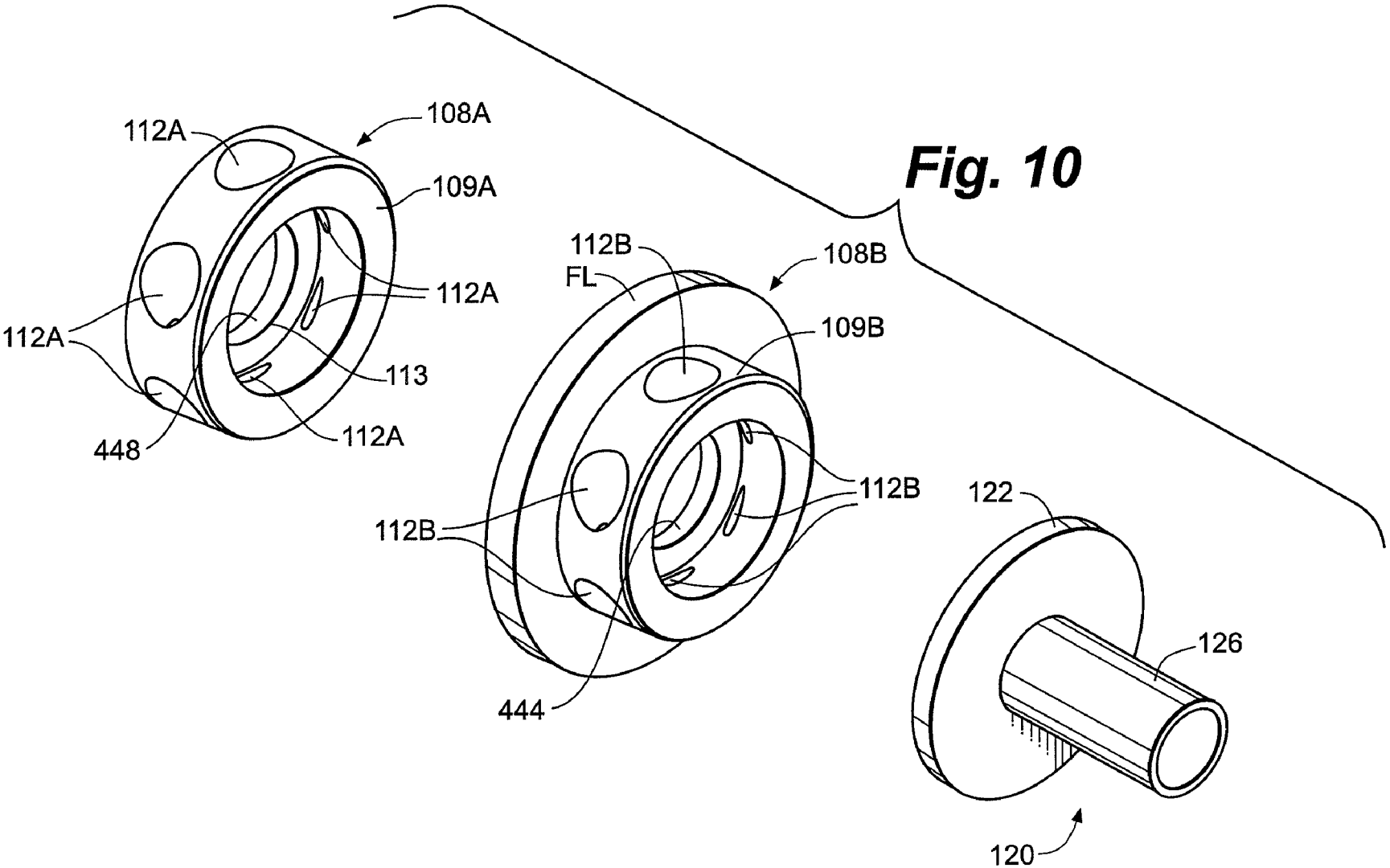
FIG. 10 is an exploded view of a multiple-generator sub-assembly for an energy transfer apparatus in accordance with certain embodiments of the invention.
Figure 11A:
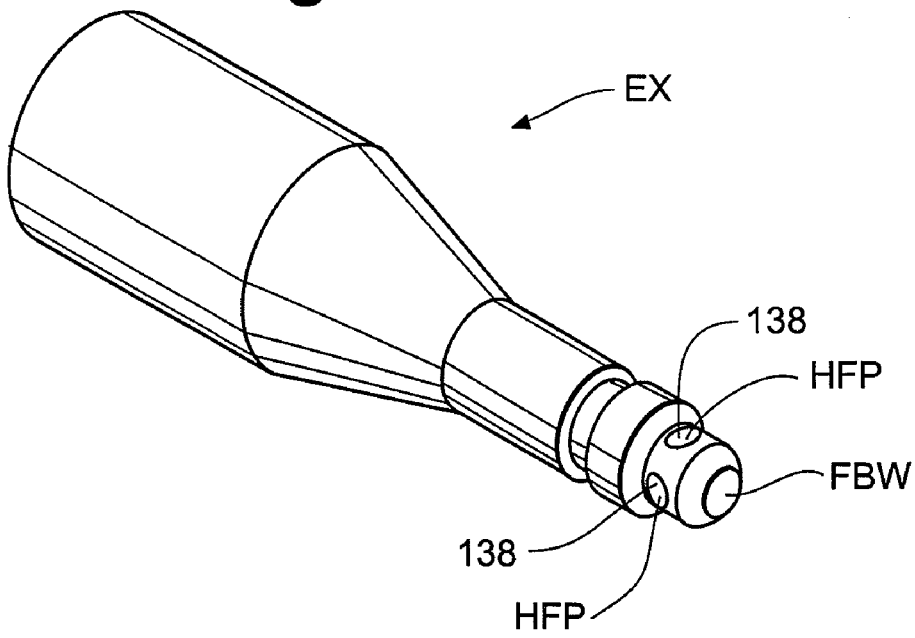
FIG. 11A is a perspective view of an exhaust member for an energy transfer apparatus in accordance with certain embodiments of the invention.
Figure 11B:
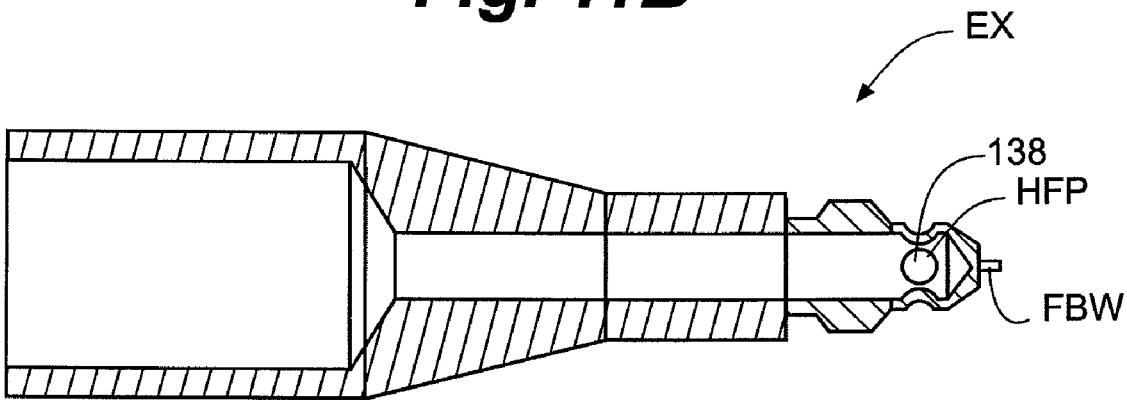
FIG. 11B is a cross-sectional view of the exhaust member of FIG. 11A.
Figure 12A:
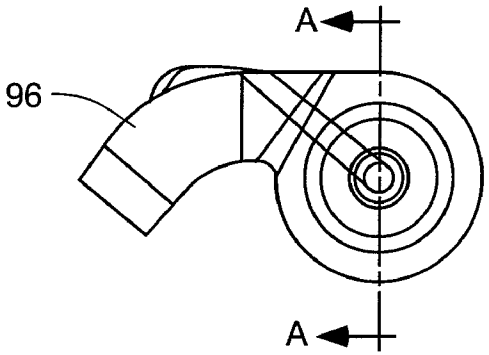
FIG. 12A is an end view of an energy transfer apparatus in accordance with certain embodiments of the invention.
Figure 12B:
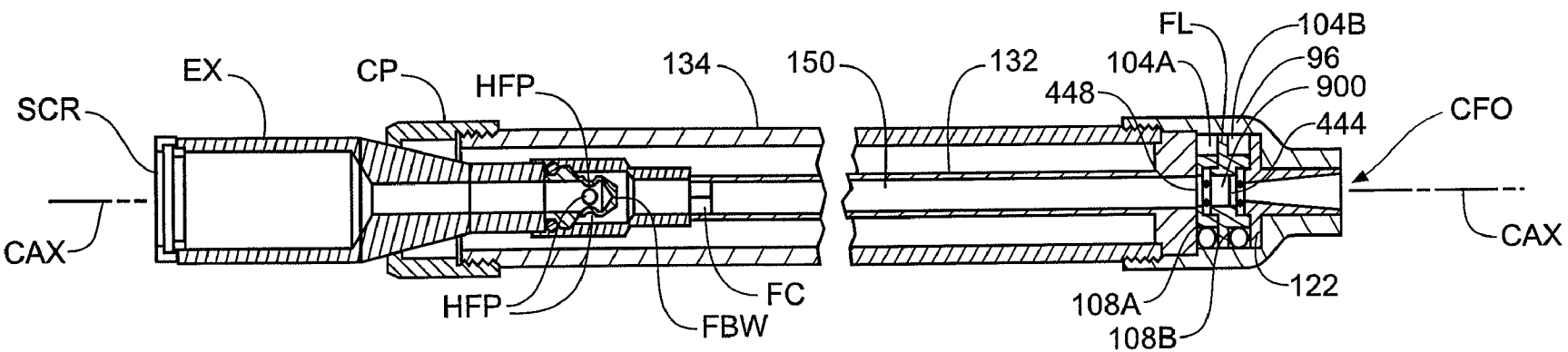
FIG. 12B is a cross-sectional view of the energy transfer apparatus of FIG. 12A, taken along lines A-A.
Figure 12C:
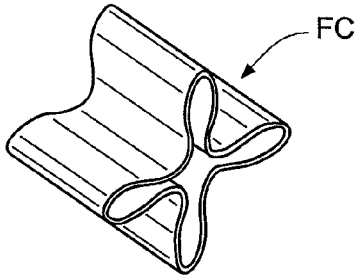
FIG. 12C is a perspective view of a flow converter for an energy transfer apparatus in accordance with certain embodiments of the invention.
Figure 12D:
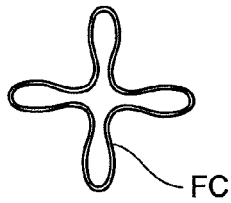
FIG. 12D is an end view of the flow converter of FIG. 12C.

In some cases, the first and second fluid flow generators 108A, 108B are separate bodies, as shown in FIGS. 2, 10, and 12B. In other cases, the first and second generators 108A, 108B are different portions of a single (i.e., integral) body, as shown in FIGS. 3 and 4. In still other cases, the energy transfer tube 132 is integral to the first and second generators 108A, 108B. For example, the energy transfer tube 132, the first and second generators 108A, 108B, and two extension tubes (or other equivalent structures) 111, 126 can be formed by one integral piece, which could be inserted into an isolation tube (or "dampener tube") 134 after which an inlet device 96 could be threaded onto (or otherwise coupled with) the isolation tube so as to assemble the apparatus 10. Many variants of this nature are possible. For example, it is possible to have a single body define the energy transfer tube 132, a first extension tube 111 (if provided), and the first and second generators 108A, 108B, while an optional second extension tube 126 is defined by a separate body. Other alternatives will be apparent to skilled artisans given this disclosure as a guide.

Preferably, the first generator 108A includes one or more passages 112A configured to deliver pressurized fluid into a first fluid flow chamber 110A so as to create a rotating flow in the first fluid flow chamber. The rotating flow created in the first fluid flow chamber is defined as the first rotating flow. Similarly, the second generator 108B preferably includes one or more passages 112B configured to deliver pressurized fluid into a second fluid flow chamber 110B so as to create a rotating flow in the second fluid flow chamber. The rotating flow created in the second fluid flow chamber is defined as the second rotating flow.

In FIGS. 2-4, the first generator 108A surrounds the first fluid flow chamber 110A and has a plurality of circumferentially spaced passages 112A configured to deliver pressurized fluid into the first fluid flow chamber 110A. Similarly, the second generator 108B surrounds the second fluid flow chamber 110B and has a plurality of circumferentially spaced passages 112B configured to deliver pressurized fluid into the second fluid flow chamber 110B.

Each fluid flow generator can be formed of various different materials. Examples include brass, stainless steel, and other metals. Various non-metals may also be used. The invention is not limited to use of any particular materials for the generators.

FIG. 10 shows two generators in accordance with certain preferred embodiments. The generators 108A, 108B can be provided in many different forms. For example, each generator can alternatively have one single passage 112A, 112B. This passage can take different forms (a single tangential passage, a single snail-shell type passage, etc.). Preferably, the passage or passages of each generator 108A, 108B is/are configured to deliver pressurized fluid into a fluid flow chamber 110A, 110B so as to create a rotary fluid flow in the chamber. One alternative is to simply have each generator be a hose, nozzle, or the like that delivers fluid from a pressurized fluid source tangentially into a fluid flow chamber 110A, 110B. In such cases, the illustrated annular inlet chambers 104A, 104B could be omitted, and each generator could deliver fluid from the pressurized fluid source directly into a fluid flow chamber 110A, 110B.

Figure 8A:
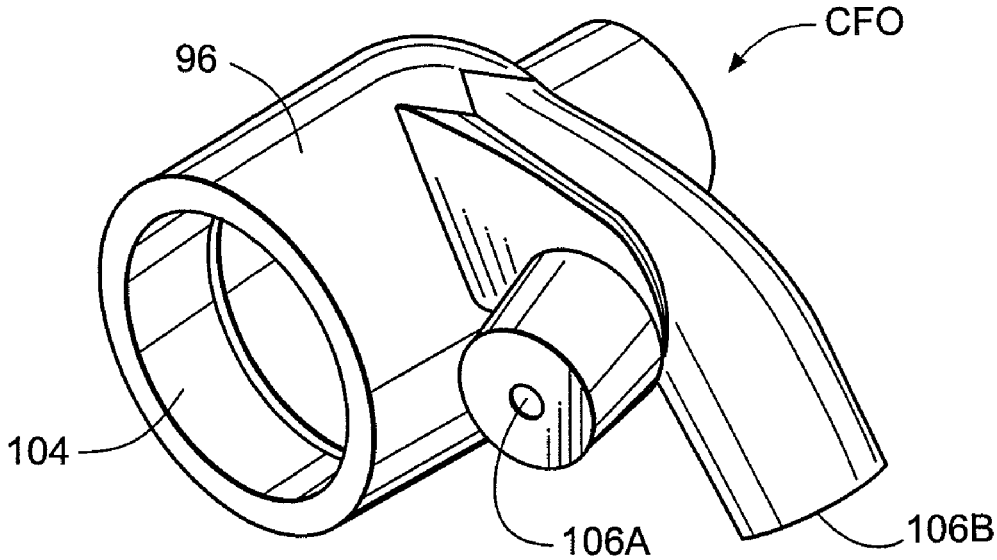
FIG. 8A is a perspective view of an inlet device for an energy transfer apparatus in accordance with certain embodiments of the invention.
Figure 8B:
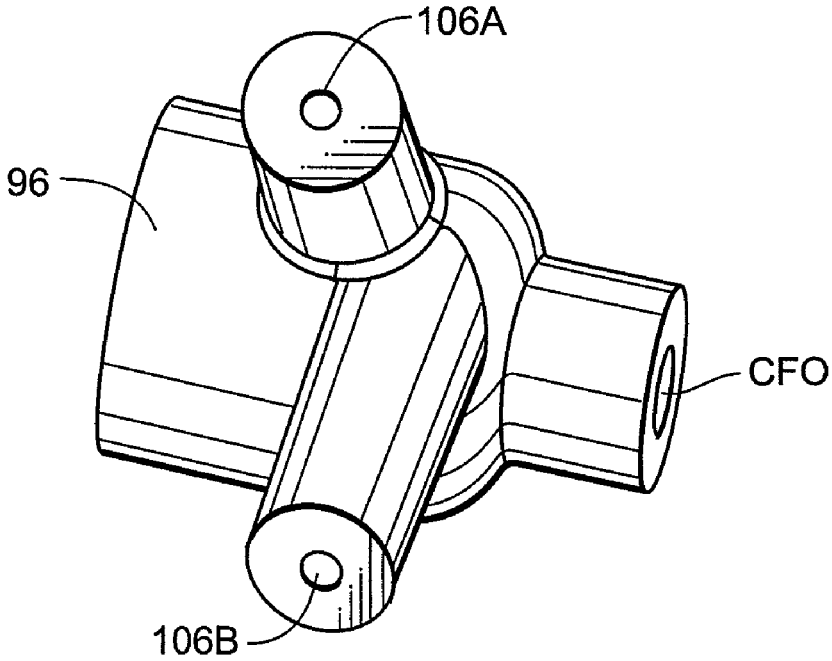
FIG. 8B is a perspective view of another inlet device for an energy transfer apparatus in accordance with certain embodiments of the invention.

In the embodiments of FIGS. 2-4, however, the energy transfer apparatus 10 includes first and second inlet chambers 104A, 104B. These embodiments also include one or more inlet devices 96. The inlet device(s) 96 is/are adapted to deliver pressurized fluid into the illustrated first and second inlet chambers 104A, 104B. In FIGS. 2-4, a single inlet device (e.g., a single body) 96 defines separate first and second inlet passages 106A, 106B, which lead respectively (via respective inlet chambers 104A, 104B) to the first and second fluid flow generators 108A, 108B. This particular inlet device 96 is perhaps best seen in FIG. 5. FIGS. 8A and 8B depict two other inlet devices that can be used. As another alternative, the illustrated body 96 can be replaced with separate bodies respectively defining the first and second inlet passages 106A, 106B.

When provided, the inlet body or bodies can be formed of various materials. Examples include brass, stainless steel, and other metals. Various non-metals may also be used. Here again, the particular material used is by no means limiting.

Figure 5:
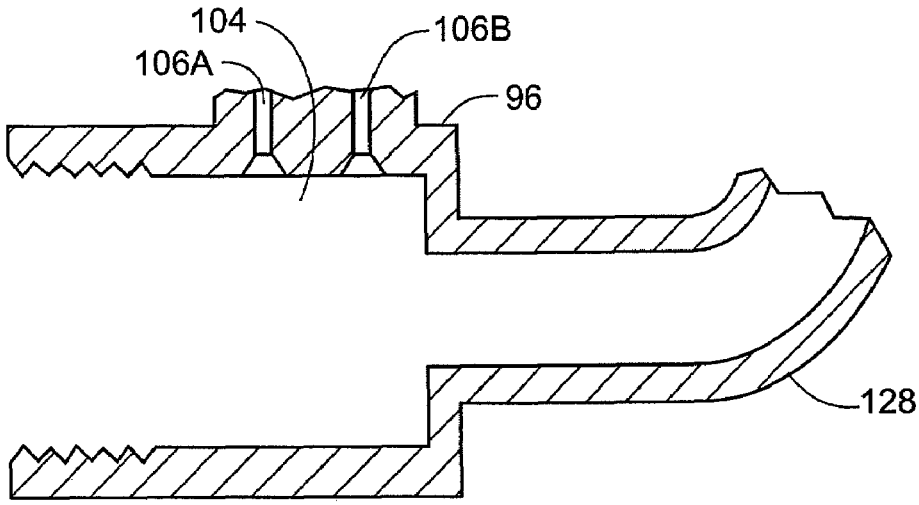
FIG. 5 is a sectional view of an inlet device for an energy transfer apparatus in accordance with certain embodiments of the invention.

Referring to FIGS. 5, 8A, and 8B, the illustrated inlet device 96 bounds an interior space (or "chamber") 104, which preferably is at least generally or substantially cylindrical. When the illustrated apparatus 10 is operatively assembled, the first and second generators 108A, 108B are both located within (or "housed by") the inlet device 96 (i.e., in its interior chamber 104). The apparatus 10, however, can be configured in many different ways, and the inlet device is not strictly required to surround the fluid flow generators.

The inlet device 96 can be connected, such as by tubes, to a source of fluid under pressure. Referring to FIGS. 2-4 and 6, the inlet device (i.e., one or more bodies thereof) 96 preferably bounds each of the inlet chambers 104A, 104B. Each illustrated inlet chamber 104A, 104B is annular. However, other configurations may be used.

In FIGS. 2-4, each inlet passage 106A, 106B is oblique to the radius of the inlet chamber into which it opens. This is best seen in FIG. 6. While this is preferred, it is not always required. For example, in alternate embodiments, there may be at least one inlet passage that is aligned with a radius of the inlet chamber into which it opens.

Thus, in some embodiments, the apparatus 10 includes a first inlet chamber 104A having an annular configuration, and an inlet device 96 having a first inlet passage 106A through which pressurized fluid is adapted to flow when being delivered into the first inlet chamber 104A. In these embodiments, the first inlet passage 106A can advantageously be oblique to a radius of the first inlet chamber 104A. Additionally or alternatively, the apparatus 10 can include a second inlet chamber 104B having an annular configuration, and the inlet device 96 can have a second inlet passage 106B through which pressurized fluid is adapted to flow when being delivered into the second inlet chamber 104B. The second inlet passage 106B can advantageously be oblique to a radius of the second inlet chamber 110B.

In the illustrated embodiments, each inlet passage 106A, 106B includes a bore of uniform diameter that flares outwardly into an inlet chamber 104A, 104B. In a practical example, the flare is provided by a conical taper and the diameter of each inlet chamber 104A, 104B is 0.645 inch. When provided, the conical taper (which, for example, can be machined using a 45 degree burr) can optionally be coaxial with the uniform-diameter portion of the inlet passage 106A, 106B. It is to be understood that these features are optional, and need not be present in other embodiments.

The first generator 108A includes a passage (preferably a plurality of passages) 112A configured to receive pressurized fluid (optionally from a first inlet chamber 104A) and deliver that pressurized fluid into a first fluid flow chamber 110A, so as to create a rotating flow in the first fluid flow chamber. The rotating flow created in the first fluid flow chamber is referred to as the "first rotating flow." Similarly, the second generator 108B includes a passage (preferably a plurality of passages) 112B configured to receive pressurized fluid (optionally from a second inlet chamber 104B) and deliver that pressurized fluid into a second fluid flow chamber 110B, so as to create a rotating flow in the second fluid flow chamber. The rotating flow created in the second fluid flow chamber is referred to as the "second rotating flow."

Thus, the apparatus 10 has a plurality of (i.e., two or more) fluid flow generators. In embodiments like those shown in FIGS. 2-4 and 12B, the energy transfer apparatus 10 has only two fluid flow generators 108A, 108B, and both are located (optionally side-by-side) adjacent to the apparatus' cold-discharge end. With these two generators, eight fluid flow layers can be established. In other embodiments, the apparatus may include three or more generators.

The illustrated energy transfer chamber 150 has first and second ends (as does the illustrated energy transfer tube 132). This chamber 150 is in fluid communication with the first and second fluid flow chambers 110A, 110B, preferably such that the first and second rotating flows extend (respectively) from the first and second fluid flow chambers 110A, 110B, into the energy transfer chamber 150 (e.g., into tube 132), and toward the second end of the energy transfer chamber 150 (e.g., toward the second end of tube 132). The second end of chamber 150 has one or more hot-fluid ports HFP opening outwardly from the energy transfer chamber.

Some fluid from the outermost flow escapes from the energy transfer chamber 150 through the hot-fluid port(s) HFP, but a major portion returns back through the energy transfer chamber 150 (as the "innermost" flow) toward the first end and escapes through the cold-fluid outlet CFO. In connection with the "outer" flow, after this flow passes once through the energy transfer chamber 150, at least most of this flow returns back through the energy transfer chamber 150 (as the "inner flow"), and then leaves through the cold-fluid outlet CFO. As noted above, there may be some mixing between the first flow (which includes the outer and inner flows) and the second flow (which includes the outermost and innermost flows). Thus, some fluid from both flows may escape through the hot-fluid port(s) HFP.

Operation of the apparatus 10 results in a stream of cold fluid flowing from the cold-discharge end while a stream of hot fluid flows simultaneously from the hot-discharge end. The stream of cold fluid is at a lower temperature than pressurized fluid delivered into the apparatus 10, while the stream of hot fluid is at a higher temperature than pressurized fluid delivered into the apparatus.

The stream of cold fluid emanating from the apparatus may, for example, be colder than the temperature of the fluid supplied into the apparatus by at least 100 degrees F., by at least 125 degrees F., by at least 150 degrees F., or even by at least 200 degrees F. As already explained, though, the desired temperature separation may be greater or lesser, depending upon the particular application and the desired performance.

Thus, the stream of cold fluid desirably has a cold-end outlet temperature that is adjustable. In some embodiments, the cold-end outlet temperature can be changed by performing a clutching step. The clutching step, for example, can involve simultaneously maintaining a first inlet pressure at a substantially constant level while changing (or "adjusting") a second inlet pressure. The "first inlet pressure" is the pressure of the pressurized fluid that is delivered to the apparatus for the first generator 108A. Thus, for embodiments involving an inlet device 96 and inlet chambers 104A, 104B, the first inlet pressure is the pressure at which pressurized fluid is delivered to the first inlet chamber 104A (i.e., the pressure the fluid is at when delivered from a pressurized fluid source through the first inlet passage 106A). Similarly, the "second inlet pressure" is the pressure of the pressurized fluid that is delivered to the apparatus for the second generator 108B. For embodiments involving an inlet device 96 and inlet chambers 104A, 104B, the second inlet pressure is the pressure at which pressurized fluid is delivered to the second inlet chamber 104B (i.e., the pressure the fluid is at when delivered from a pressurized fluid source through the second inlet passage 106B). In other cases, such as where the generators deliver pressurized fluid directly from the source into the fluid flow chambers (e.g., where inlet chambers are omitted), the "first inlet pressure" is the pressure the fluid is at when delivered through the first generator, while the "second inlet pressure" is the pressure the fluid is at when delivered through the second generator.

Some embodiments involve delivering a first inflow through a first inlet passage 106A of the apparatus, and delivering a second inflow through a second inlet passage 106B of the apparatus. In some cases, the second inflow has a flow rate that is different than, but no more than 50% greater or less than, that of the first inflow.

Thus, the apparatus desirably provides the feature of being able to adjust the outflow temperature at the cold end of the apparatus 10 by adjusting the pressure of the fluid delivered at the second generator 108B, while holding constant the pressure of the fluid delivered at the first generator 108A.

As an alternative, it is possible to have the first generator 108A be the clutching generator (instead of having the second generator be the clutching generator, as described above). It is to be appreciated that the clutching generator preferably is the one that generates the outermost rotating flow (i.e., the rotating flow closest to the wall of the energy transfer tube 132).

Thus, the apparatus preferably has a cold fluid outlet with an outflow temperature that can be adjusted by adjusting a pressure of fluid delivered to one of two generators, defined as a clutching generator, while holding constant a pressure of fluid delivered to the other of the two generators. In some such cases, the rotating fluid flow created by the clutching generator is an outermost rotating flow, which is located closer to an inside wall of the energy transfer tube than is the rotating fluid flow created by the other of the two generators.

When provided, the inlet device 96 preferably defines separate first and second inlet paths 106A, 106B, e.g., such that a first supply flow at one pressure can be delivered into the first inlet chamber 104A while a second supply flow at a different pressure can be delivered simultaneously into the second inlet chamber 104B. This structural feature provides a number of performance benefits. For example, by running the second generator 108B at a higher pressure than the first generator 108A, a particularly cold outlet temperature can be achieved.

In the illustrated embodiments, the first and second generators 108A, 108B are coaxial to each other. Thus, the illustrated flow chambers 110A, 110B (which are bounded outwardly by the illustrated first and second generators 108A, 108B, respectively) are centered on a common central axis. In FIGS. 2-4 and 12B, the energy transfer chamber 150 is also centered on this axis CAX. Thus, the illustrated energy transfer tube 132 is coaxial to the first and second generators 108A, 108B. The same is true of the optional extension tubes 111, 126. These features, however, are not strictly required.

Preferably, the internal flow chambers 110A, 110B of the first and second generators 108A, 108B each have a cross section (taken in a plane perpendicular to the central axis) that is at least generally or substantially circular. This can be appreciated by referring to FIGS. 6 and 10. The energy transfer chamber 150 preferably has a circular cross section as well (taken in the noted plane), as do the illustrated energy transfer tube 132 and extension tubes 111, 126. However, one or more of these cross sections can have other configurations. Moreover, the energy transfer chamber 150 can optionally be a cylindrical interior space defined by an interior surface of a generally square or rectangular block.

In certain preferred embodiments, the first and second generators 108A, 108B are both located adjacent to the cold-discharge end of the apparatus 10. The first and second generators, for example, can be located side-by-side (optionally at one end of an energy transfer tube 132). In embodiments like those of FIGS. 2 and 12B, the second generator 108B is positioned alongside (optionally directly against) the first generator 108A. Here, a portion (e.g., an annular boss or another projection) of the second generator 108B is received in the internal chamber 110A bounded by the first generator 108A. This, however, is by no means required.

As noted above, the generators 108A, 108B can optionally be located inside the inlet device 96 (e.g., within its interior chamber 104). Referring to FIGS. 2, 10, and 12B, the illustrated first generator 108A includes an annular portion 109A, which has an outer surface spaced radially from an inner surface of the inlet device 96. This annular portion 109A bounds the first flow chamber 110A. In FIG. 2, this annular portion 109A has an internal flange 113, and a first extension tube 111 projects from this flange 113. This annular portion 109A is formed with the passages 112A that provide fluid communication between chambers 104A and 110A.

With continued reference to FIGS. 2, 10, and 12B, the illustrated second generator 108B includes an annular portion

109B, which has an outer surface spaced radially from the inner surface of the inlet device 96. This annular portion 109B bounds the second fluid flow chamber 110B. This annular portion 109B includes an annular boss that fits in chamber 110A. Also, the illustrated second flow generator 108B includes an external flange FL that separates the two inlet chambers 104A, 104B.

With reference to FIGS. 2, 3, and 10, the illustrated generators are held in position by a separate structure (a "flow generator holder"). The illustrated holder 120 has an external flange 122, which centers the holder 120 in chamber 104. When provided, the holder 120 can be formed of various materials, such as plastic. The illustrated holder 120 includes an annular boss 124, and in FIG. 2, one end region of this boss 124 fits in chamber 110B. The embodiment of FIG. 4 is somewhat different, in that a single body defines both the structure 120 and the generators 108A, 108B. Preferably, structure 120 defines a second extension tube 126 formed with a passage that flares outward from a minimum diameter, which preferably is smaller than the interior diameter of the illustrated first extension tube 111. In FIGS. 2-4, the illustrated second extension tube 126 projects into an outlet tube 128, which is shown as being part of the inlet device 96 (although this is by no means required). When provided, the outlet tube 128 can optionally be connected through a muffler, tubing, or another conduit to an area or component to be cooled.

In one practical design of the embodiment shown in FIG. 2, the external diameter of each annular portion 109A, 109B is 0.475 inch, and each annular inlet chamber 104A, 104B has a radial extent or depth of 0.085 inch (this depth being the distance between the external surface of annular portion 109A, 109B and the internal surface of body 96).

The internal surface of body 96 can optionally be machined with grooves having a depth in the range of between about 0.002 inch and about 0.008 inch. As one example, there may be about 15 grooves per inch. The optional grooves can be provided to straighten/smooth-out flow in the inlet chamber. The grooves can be similar to threading, but with rounded valleys. When provided, the grooves preferably are oriented so extend circumferentially along an inside wall of body 96, e.g., such that the length of the groove is generally perpendicular to a central axis of the body 96, as opposed to being generally parallel to such axis.

In certain preferred embodiments, a passage 112A (or at least a portion thereof) of the first generator 108A lies in a plane inclined at an angle (preferably at least 1 degree, e.g., from 4 degrees to 30 degrees) relative to a plane perpendicular to a central axis of the first flow chamber 110A. Additionally or alternatively, a passage 112B (or at least a portion thereof) of the second flow generator 108B can lie in a plane inclined at such an angle relative to a plane perpendicular to a central axis of the second fluid flow chamber 110B. In some cases, a terminal length (i.e., the portion closest to the flow chamber into which it opens) of each passage is oriented at such an angle. For embodiments where each generator has multiple passages, this angular orientation can optionally be provided for each passage. This orientation of the passages 112A, 112B is desirable to start flow moving toward the hot end of the apparatus.

Further, a passage 112A of the first generator 108A can advantageously have a curved configuration (in a cross section taken along a plane perpendicular a central axis of the first flow chamber 110A). Reference is made to FIG. 6. Additionally or alternatively, a passage 112B of the second fluid flow generator 108B can advantageously have a curved configuration (in a cross section taken along a plane perpendicular a central axis of the second flow chamber 110B). For embodiments where each generator has multiple passages, this curved orientation can optionally be provided for each passage. Thus, in FIG. 6, each passage 112A is curved, e.g., so that the axis of the passage at the inner end is at an angle of about 2-4 degrees relative to the axis of the passage at the outer end. The same can optionally be true of each passage 112B in the second fluid flow generator 108B.

Preferably, the first generator 108A has a plurality of passages 112A configured to deliver pressurized fluid into the first fluid flow chamber 110A. Additionally or alternatively, the second generator 108B can have a plurality of passages 112B configured to deliver pressurized fluid into the second fluid flow chamber 110B. The number of passages 112A, 112B in each generator 108A, 108B will commonly range from four to eight. For example, each generator 108A, 108B may have six passages 112A, 112B.

In embodiments like FIG. 6, the inlet to each passage 112A can be formed using, for example, a 30-degree conical tool that is initially aligned with the radius of the outer peripheral surface of the first generator and then tilted or deflected along the periphery of that generator to extend the inlet. Thus, the downstream (relative to the direction of fluid flow in the annular chamber) surface of the illustrated inlet is relatively steep, whereas the upstream surface provides a smoother transition from the peripheral surface of the generator to promote flow of fluid from the annular chamber into the passages 112A. The passage(s) 112B in the second generator 108B can be similarly configured, if so desired. Thus, each of these inlets can optionally be elongated about the periphery of the generator in which it is formed. In one practical embodiment, each such inlet has a length (peripheral dimension) of 0.045 inch and a width (parallel to the central axis of the generator) of 0.030 inch.

The illustrated passages 112A, 112B are of uniform diameter inward of the taper. The angle between the upstream interior surface of the tapered inlet to the passage (relative to the direction of flow in the annular chamber) and the outer periphery of the generator is illustrated as being about 38 degrees (plus or minus 2 degrees), and the axis of the passage at its inner end is illustrated as being about 40 degrees (plus or minus 2 degrees) relative to the surface that bounds the fluid flow chamber. These features, however, are merely exemplary.

In some embodiments, the generators 108A, 108B are formed of metal or metal alloy. For example, brass is used in some embodiments. Alternatively, the generators can be formed of other materials, such as synthetic resin materials. Generally, it is possible to either machine the generators or cast them. Machining may be preferred to meet the tolerances desired. If desired, the passages 112 can be fabricated by a lost wax process. The generators can be fabricated by other processes, such as injection molding. In one example, the generators are formed of brass, and are made by casting.

The size of passages 112A, 112B has been exaggerated for clarity in FIGS. 2-4 and 6. In one practical embodiment, the passages are 0.022 inch in diameter. The size of the passages will depend upon the desired operating characteristics of the generators. For example, passages of diameter up to 0.0625 inch are provided in other embodiments. Thus, in some embodiments, the passages 112A, 112B each have a diameter of between about 0.01 inch and about 0.1 inch. It is anticipated, however, that larger or smaller diameters will certainly be used in other embodiments.

In certain embodiments, a flow-delivery passage (or "connection passage") 900 extends between the first and second fluid flow chambers 110A, 110B. This is perhaps best shown in FIGS. 2-4. Here, the apparatus 10 includes an energy transfer chamber 150, a first fluid flow chamber 110A, a flow-delivery passage 900, and a second fluid flow chamber 110B (and they are all coaxial in FIGS. 2-4). When provided, the flow-delivery passage 900 preferably has a cross section (taken perpendicular to the central axis) that is at least generally or substantially circular. In FIG. 2, the flow-delivery passage 900 is defined by the second generator 108B. Alternatively, the flow-delivery passage 900 can be defined by a single body that forms both the first and second generators 108A, 108B. This is shown in FIGS. 3 and 4. Another alternative is to have the first generator define the flow-delivery passage. Still further, the generators can be arranged such that there is no flow-delivery passage of this nature, but rather the first and second flow chambers 110A, 110B can be right next to each other, e.g., with the second flow chamber 110B having a larger (e.g., slightly larger) diameter than the first flow chamber 110A.

When provided, the flow-delivery passage 900 can have an internal diameter that can be varied to accommodate different applications. In some cases, this diameter is between about 0.02 inch and about 1 inch. In one practical embodiment, this diameter is about 0.214 inch. These dimensions, however, are merely exemplary, as the apparatus can be scaled widely to accommodate different applications.

In FIGS. 2-4, the first and second fluid flow chambers 110A, 110B both have internal diameters larger than the internal diameter of the flow-delivery passage 900. The internal diameters of the flow chambers 110A, 110B can be varied to suit different applications. In some cases, these diameters range between about 0.12 inch and about 1.1 inch. In one practical embodiment, the internal diameter of each fluid flow chamber 110A, 110B is about 0.322 inch. Again, the noted dimensions are merely exemplary, since the dimensions of the apparatus will vary depending on the particular purpose for which it is used.

It will commonly be preferred for both fluid flow chambers 110A, 110B to have the same internal diameter, as this can minimize the work required to optimize pressure and volume parameters. However, it is also possible to use different diameters for the first and second fluid flow chambers.

In FIGS. 2-4, a first extension tube 111 defines a passage from the first generator 108A to the energy transfer chamber 150. When provided, the first extension tube 111 preferably has an internal diameter that is smaller (e.g., slightly smaller) than the internal diameter of the flow-delivery passage 900. In FIG. 12B, the energy transfer tube 132 has an internal diameter that is slightly smaller than the internal diameter of the flow-delivery passage 900. Here, the first extension tube 111 has been omitted. In one practical embodiment, the internal diameter of the energy transfer tube 132 is about 0.213 inch, while the internal diameter of the flow-delivery passage 900 is about 0.214 inch. In this practical example, the internal diameter of chamber sections 444 and 448 are both about 0.218 inch. Such relative dimensioning allows the rotating flow from the second generator 108B (e.g., the outermost flow) to be slipped into its desired location without disrupting the rotating flow from the first generator 108A.

Thus, in one group of embodiments, the internal diameter of the first extension tube 111 (or of the energy transfer tube 132) is smaller than the internal diameter of the flow-delivery passage 900 by at least 0.0001 inch, preferably by at least 0.0005 inch, and perhaps optimally by at least 0.001 inch. In certain embodiments, the difference is less than 0.01 inch, and preferably less than 0.005 inch, such as between about 0.001 inch and about 0.004 inch.

A second extension tube 126 can optionally extend from the second generator 108B toward the cold-fluid outlet CFO. In some embodiments of this nature, the second extension tube 126 has a flared configuration with an internal diameter that becomes gradually larger with increasing distance from the second generator. In FIGS. 2-4, the minimum internal diameter of the second extension tube 126 is located adjacent to the second generator 108B (and/or adjacent to the second flow chamber 110B). Preferably, this minimum internal diameter is smaller than the diameter (or the minimum diameter) of the first extension tube 111. In one practical example, the minimum diameter of the second energy tube 126 is about 0.123 inch.

Thus, in some embodiments, the apparatus 10 includes an energy transfer chamber 150, an optional first extension tube 111, a first fluid flow chamber 110A, an optional flow-delivery passage 900, a second fluid flow chamber 110B, and an optional second extension tube 126. And they can all be coaxial to one another (e.g., centered on a common central axis CAX).

Preferably, the second end of the energy transfer chamber 150 is partially closed by a structure comprising a flow-blocking wall FBW. The flow-blocking wall FBW, for example, can be located radially inwardly from a plurality of hot-fluid ports HFP, which in FIGS. 2-4 open outwardly from the energy transfer chamber 150. As an alternative, it may be possible to have just one hot-fluid port HFP. In some embodiments, the structure at the second end of the energy transfer chamber 150 comprises a throttle valve 136 that is movable (e.g., lengthwise of chamber 150) to adjust an effective length of the energy transfer chamber 150. In other embodiments, the hot-fluid ports are fixed orifices in a wall closing the hot end of the apparatus (this wall could be an end wall, or a side wall, of tube 132). In still other embodiments, the hot end of the apparatus is equipped with a cone valve. FIGS. 7A, 7B, 11A, 11B, and 12B depict a particularly advantageous exhaust member EX. Skilled artisans will appreciate that a variety of useful structures can be used at the hot end of the apparatus.

In FIGS. 2-4, the illustrated apparatus 10 has a throttle valve 136 in threaded engagement with a fitting at the second end of the energy transfer tube 132. This throttle valve 136 is hollow and defines an interior space that communicates with the interior of the energy transfer tube 132 through radial openings 138 and longitudinal grooves 140. The location of the grooves 140 is such that only fluid close to (or "adjacent to") the wall of the tube 132 can escape from the tube 132 through the throttle valve 136 (and hence to atmosphere through the isolation tube 134 and a muffler, when provided). Preferably, this is the case for the opening(s) that serve as the hot fluid port(s) HFP, regardless of the particular structure used. For example, the exhaust member EX shown in FIGS. 7A, 7B, 11A, 11B, and 12B has a plurality of openings 138 through which hot fluid near the tube's inner wall can escape.

When provided, the throttle valve 136 or exhaust member EX contributes to the favorable performance of the energy transfer apparatus 10 by ensuring that the hottest fraction of the flow in the energy transfer chamber 150 is removed and cannot mix with cooler fluid closer to the central axis CAX of the energy transfer chamber 150.

With reference to FIGS. 12B-12E, it can be seen that the energy transfer chamber 150 can optionally be equipped with a flow converter FC. The flow converter, when provided, is intended to straighten the flows that pass through it. The configuration and dimensions shown are merely exemplary. For example, the flow converter can have as many as eight points (or "cusps") pointing toward the center. Thus, a flow converter with 4-8 cusps may be preferred. In other cases, though, the flow converter may be omitted. On the other hand, it may be desirable to have two or more flow converters in some situations.

Figure 12E:
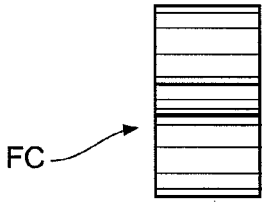
FIG. 12E is a side view of the flow converter of FIG. 12C.

When provided, the flow converter can be formed of various materials. In one practical example, a spring steel of 0.06 inch wall thickness is used. The length of the flow converter in such a practical example can, for example, be about 0.125 inch (this length being the left-to-right dimension as seen in FIG. 12E). Again, the noted dimensions are merely examples—they are by no means limiting.

In some embodiments, the apparatus includes a dampener (such as an isolation tube) 134. When provided, the dampener preferably comprises a tube or another wall that surrounds the energy transfer tube, leaving an isolation space (optionally an air space) between the energy transfer tube and the dampener. The dampener 134 serves to isolate the energy transfer tube 132 from external vibrations, which might otherwise suppress acoustic toning of the energy transfer tube 132, thereby degrading performance. FIG. 12B shows one exemplary manner of assembling an isolation tube 134. Here, the isolation tube 134 can be threaded, press fit, or otherwise coupled to the inlet body 96. The isolation tube 134 can, for example, be formed of brass, stainless steel, or other metals. Various non-metals may be used as well. The particular material used is not limiting to the invention.

In the embodiment of FIG. 12B, the illustrated exhaust member EX is threadingly connected to the energy transfer tube. In a practical example, these two parts have a threaded connection with a threaded distance of about 0.16 inch. The illustrated exhaust member cooperates with the cap CP of the dampener 134 to retain the dampener in its operable position surrounding the energy transfer tube. In FIG. 12B, the outlet end of the exhaust member is provided with an optional screen SCR.

In some preferred embodiments, the first 108A and second 108A generators (and optionally the energy transfer tube 132) are all non-moving parts assembled in fixed positions so as to remain stationary during operation of the apparatus. The same may be true of the optional extension tubes 111, 126, the inlet device 96, the dampener tube 134, and the exhaust member EX, when provided.

Referring now to FIG. 13, it can be appreciated that the inner flow is located radially between the innermost flow and the outer flow, the outer flow is located radially between the inner flow and the outermost flow, and the outermost flow is located radially between the outer flow and the wall of the tube. Thus, there are eight fluid flow layers here. As used herein, the term "fluid flow layer" means a layer of fluid flow (counting across a cross section taken along a plane lying on a central axis of the energy transfer chamber) that extends along at least half the length of the energy transfer chamber 150 (e.g., extends along at least half the length of an energy transfer tube 132), and preferably extends along at least ¾ of the length, and perhaps optimally along substantially the entire length. While the illustrated outermost flow is the one closest to the inner wall of the energy transfer tube, it may be preferable for the outermost flow not to actually contact the inner wall of the energy transfer tube.

With continued reference to FIG. 13, moving diametrically from one location on the tube's inner wall to a diametrically-opposed location on the tube's inner wall, there are located, in sequence, two flow layers moving toward the hot outlet end of the apparatus, then two flow layers moving toward the cold outlet end, then two more flow layers moving toward the cold outlet end, following by two flow layers moving toward the hot outlet end of the apparatus. Reference is made again to FIG. 13. It is to be appreciated that there may be more than eight fluid flow layers in some embodiments.

Thus, certain embodiments provide an apparatus for transferring energy by rotating fluid within the apparatus. The apparatus has a cold-fluid-discharge end and a hot-fluid-discharge end. The cold-fluid-discharge end comprises a cold fluid outlet, and the hot-fluid-discharge end comprises one or more hot fluid ports. The apparatus 10 includes an energy transfer chamber (optionally bounded by an energy transfer tube) and a plurality of fluid flow generators. In the present embodiments, the fluid flow generators are collectively adapted to create at least eight fluid flow layers extending through the energy transfer tube. As noted above, these fluid flow layers are counted as found in a cross section taken along a plane lying on a central axis of the energy transfer tube. And each of the eight fluid flow layers extends along at least a major length of the energy transfer tube. Preferably, each adjacent pair of fluid flow layers have friction values between them. If desired, more than eight fluid flow layers can be present, e.g., if additional generators are provided.

By way of non-limiting example, the rotating flows in the apparatus 10 may exceed 500,000 rotations per minute, such as between about 750,000 rpm and about 1.25 million rpm. In some cases, the rpm may be less than 1 million rpm, perhaps 900,000 rpm or less, 800,000 rpm or less, or perhaps lower in some cases. This can be varied depending on the specific apparatus being used and the intended performance.

Operation of the apparatus 10 produces a stream of cold fluid from the cold-fluid-discharge end while simultaneously producing a stream of hot fluid from the hot-fluid-discharge end. Typically, the stream of cold fluid will be at a lower temperature than the pressurized fluid delivered into the apparatus 10 (the fluid supplied into the apparatus will commonly be at ambient temperature, although this is not required), while the stream of hot fluid is at a higher temperature than the pressurized fluid delivered into the apparatus. In one exemplary group of embodiments, pressurized air is delivered into both generators at a temperature of about 90 degrees Fahrenheit, the hot outlet temperature is over 175 degrees Fahrenheit, and the cold outlet temperature is below −50 degrees Fahrenheit. Reference is made to Table 1 below.

The present apparatus and methods can achieve exceptional efficiency. This can be quantified in terms of coefficient of performance. The coefficient of performance (or "C.O.P.") is a known measure of efficiency, and is used herein in accordance with its well known meaning. Briefly, the coefficient of performance is the ratio of the amount of cooling provided (i.e., the amount of work performed) by the apparatus relative to the energy consumed by the apparatus. The higher the coefficient of performance the more efficient the apparatus. The present energy transfer apparatus 10, and its methods of use, can achieve a coefficient of performance within different ranges. In most cases, the C.O.P. will be at least 0.3, e.g., higher than 0.5. The C.O.P. will commonly be 1.0 or higher, 2.0 or higher, or even 2.5 or higher, e.g., between 2.5 and 3.0. If desired, it is possible to achieve a far higher coefficient of performance (such as over 20). In contrast, conventional vortex tubes have much lower coefficients of performance. It is to be understood, however, that there are some applications where it is practical to deliver great flows of cool fluid under conditions that do not involve a high coefficient of performance. Thus, the present invention is by no means limited to any particular range for the coefficient of performance.

In operation, a compressor, pump, or other source provides pressurized fluid for the apparatus. Commonly, the fluid delivered into the apparatus is initially at ambient temperature, e.g., at room temperature, although this is not required.

In FIGS. 2-4, and 12, pressurized fluid is delivered through the first and second inlet passages 106A, 106B to the first and second inlet chambers 104A, 104B, respectively. Here, when fluid under pressure passes through the inlet passages 106A, 106B and enters the inlet chambers 104A, 104B, a rotating flow is created in each inlet chamber 104A, 104B. Since each inlet passage 106A, 106B preferably is inclined to the radius of each inlet chamber 104A, 104B (at least where the passage opens into the inlet chamber), the fluid flow in each inlet chamber 104A, 104B rotates, e.g., in the counter clockwise direction as seen in FIG. 6. In other embodiments, the inlet chambers are omitted, and pressurized fluid flows directly from the source through first and second generators and into the first and second fluid flow chambers. Either way, fluid flows from the flow generators 108A, 108B into the fluid flow chambers 110A, 110B, creating first and second rotating flows. These two rotating flows both initially move (in the same general direction) toward the hot end of the apparatus. In FIGS. 2-4, the first and second rotating flows pass through the optional extension tube 111 and through the energy transfer tube 132. Some fluid of the second flow escapes from the energy transfer chamber 150 through the hot-fluid port(s) HFP, optionally then flowing to atmosphere through a muffler, exhaust member, or the like. A relatively large proportion (e.g., a major portion, i.e., at least 50%) of the second flow returns back through the energy transfer chamber 150 in a revolving innermost flow and leaves through the optional second extension tube 126 and the outlet tube 128 (e.g., passing out of the cold-fluid outlet CFO). Some of the first flow may escape through the hot-fluid ports HFP, but at least most of this flow returns back through the energy transfer chamber in a revolving inner flow, as has already been described.

Thus, certain embodiments of the invention provide a method for generating a flow of cold fluid. The method uses an energy transfer apparatus 10 of the type described, which has a cold-fluid-discharge end and a hot-fluid-discharge end. Generally, the apparatus includes an energy transfer chamber 150 (optionally bounded by an energy transfer tube 132) and first and second flow generators 108A, 108B. The cold-fluid-discharge end comprises a cold fluid outlet, and the hot-fluid-discharge end comprises one or more hot fluid ports. Pressurized fluid is delivered from the first and second generators 108A, 108B into first and second fluid flow chambers 110A, 110B, respectively. This creates first and second rotating flows, which extend respectively from the first and second fluid flow chambers 110A, 110B into the energy transfer tube 132 and toward the hot-fluid-discharge end of the apparatus. As noted above, some fluid from the second rotating flow escapes through the hot-fluid ports(s) while a major portion of the second rotating flow (and at least a major portion of the first rotating flow), return back through the energy transfer tube 132 toward the cold-fluid-discharge end and escape through the cold-fluid outlet.

As noted above, many different pressurized fluids can be used in the apparatus 10. In one group of embodiments, the working fluid comprises a fluid selected from the group consisting of air, inert gas, and water. However, many other fluids can be used, as already explained.

In some embodiments, the apparatus is operated such that gas flow emanates from the hot fluid port(s) during operation of the apparatus. If desired, the apparatus may be operated such that the flow emanating from the hot fluid port(s) consists essentially of gas.

There are no strict limits on the range of pressures that can be used for fluid delivery into the apparatus 10. In one group of embodiments, each fluid stream delivered into the apparatus 10 has an inlet pressure between about 75 psi and about 200 psi, such as between 90 psi and 150 psi. This, however, is not required in all embodiments. For example, when steam or other vapor is used, it may be desirable to use higher pressures, such as between about 200 psi and about 250 psi. Pressure can be measured using conventional static pressure probes.

In one group of embodiments, the first generator 108A is operated at a constant or substantially constant pressure. This can give particularly good performance when using an energy transfer tube with multiple flow generators. Thus, in such methods, the pressure of the fluid that is delivered into the apparatus 10 and flows through the first generator 108A is kept constant, or at least substantially constant, throughout operation of the apparatus.

It may also be preferred to keep the volume of fluid flowing through the first generator 108A constant or at least substantially constant. This too can give particularly good results when using an energy transfer tube with multiple flow generators.

The flow rate through each generator can be varied depending on the particular application. In some cases, the flow rate is between about 1 cfm and about 50 cfm, such as between about 1 cfm and about 10 cfm. These ranges, however, are merely exemplary.

In certain embodiments, the pressurized fluid that is delivered into the apparatus 10 and flows through the first generator 108A has an inlet pressure of about 115 psi or less. Keeping this pressure at or below 115 psi may be preferred for avoiding flow disruption in the apparatus. In one practical example, the first inlet pressure is about 115 psi. In another practical example, the first inlet pressure is about 110 psi (see Table 1 below). These examples are by no means limiting.

The inventor has discovered that particularly cold outlet temperatures can be achieved by operating the second generator 108B at a higher pressure than the first generator 108A. In some cases, the difference is 5 psi or more, or 10 psi or more. In one preferred method, the difference is 15 psi or more. In one practical example, the first inlet pressure is about 110 psi, while the second inlet pressure is about 125 psi (other examples are shown in Table 1).

In some of the present embodiments, the method involves an apparatus 10 on which each generator is adjacent to the cold-fluid-discharge end of the apparatus. The second generator, for example, can optionally be closer to the cold-fluid-discharge end than is the first generator. This, however, is not strictly required.

In one embodiment, the apparatus is started-up by beginning the pressurized fluid flow through the passage(s) 112A of the first generator 108A before beginning the pressurized fluid flow through the passage(s) 112B of the second generator 108B. The inventor has discovered that, for at least some embodiments, this makes it possible to spontaneously establish the acoustic tone mentioned above, whereas starting both generators at the same time does not spontaneously produce this acoustic tone. It may be desirable, for example, to begin pressurized fluid flow through the passage(s) 112B of second generator 108B only after: i) pressurized fluid flow has been started through the passage(s) 112A of the first generator 108A, and ii) an acoustic tone has been generated in the apparatus (e.g., adjacent to the first fluid flow chamber 110A).

When provided, the acoustic tone can either be generated spontaneously or induced using a transducer. When inducing the acoustic tone, a conventional band or strap type frequency generator, for example, can be provided around the energy transfer tube. This type of frequency generator preferably creates frequency all along the band, rather than just at one point on the strap.

As noted above, operation of the apparatus 10 preferably results in a stream of cold fluid flowing from the cold-discharge end while a stream of hot fluid simultaneously flows from the hot-discharge end. In some embodiments, the stream of cold fluid has a cold-end outlet temperature, and the method includes changing the cold-end outlet temperature by performing a clutching step. The clutching step, for example, can comprise simultaneously maintaining a first inlet pressure at a substantially constant level while changing a second inlet pressure. The first inlet pressure is the pressure at which pressurized fluid is delivered to the first generator 108A, and the second inlet pressure is the pressure at which pressurized fluid is delivered to the second generator 108B.

In one group of preferred embodiments, the method uses an apparatus that includes: a) one or more inlet devices adapted for delivering pressurized fluid into first and second inlet chambers, b) a first fluid flow generator, which includes at least one passage extending from the first inlet chamber to the first fluid flow chamber, c) a second fluid flow generator, which includes at least one passage extending from the second inlet chamber to the second fluid flow chamber, and d) an energy transfer chamber having first and second ends. As noted above, the energy transfer chamber 150 is in fluid communication with the first and second fluid flow chambers 110A, 110B, and the second end of the energy transfer chamber 150 typically has one or more hot-fluid ports HFP opening outwardly from the energy transfer chamber.

In these particular methods, pressurized fluid is delivered from the inlet device(s) 96 into the first and second inlet chambers 104A, 104B, such that the pressurized fluid then flows through the passages 112A, 112B of the first and second generators 108A, 108B and into the first and second fluid flow chambers 110A, 110B. This creates the first and second rotating flows, which then extend respectively from the first and second fluid flow chambers 110A, 110B into the energy transfer chamber 150 and toward the second end of the energy transfer chamber. As already explained, some fluid from the second rotating flow escapes from the energy transfer chamber 150 through the hot-fluid port(s) HFP, while a major portion of the second rotating flow (and at least a major portion of the first rotating flow), return back through the energy transfer chamber 150 toward the first end and escape through at least one cold-fluid outlet CFO of the apparatus 10.

When provided, the inlet device(s) 96 can advantageously define separate first and second inlet paths 106A, 106B. Thus, the method can optionally include delivering a first supply flow at a first pressure into the first inlet chamber 104A while simultaneously delivering a second supply flow at a second pressure into the second inlet chamber 104B. In such cases, the first and second inlet pressures would be different. In one such embodiment, the second pressure is greater than the first pressure. For example, it may be desirable for the second pressure to be greater than the first pressure by at least 5 psi, at least 10 psi, or at least 15 psi.

In some embodiments where the inlet device 96 is provided, the first generator 108A is operated at a substantially constant pressure by maintaining a substantially constant pressure flowing into the first inlet chamber 104A. By way of non-limiting example, this pressure can range between 75 psi and 200 psi, such as between 90 psi and 150 psi. In one embodiment, the pressurized fluid delivered into the first inlet chamber is at a pressure of about 115 psi or less, while optionally being greater than 75 psi.

In some embodiments, a single compressor (or another single source of pressurized fluid) is adapted to supply fluid to at least two generators of the apparatus. For example, a single compressor (or other pressurized fluid source) 1800 can be adapted to deliver fluid (optionally consisting essentially of single-phase gaseous flow) to both of first 106A and second 106B inlet passages leading respectively to first 108A and second 108B generators. Thus, certain embodiments provide a method of operating the apparatus by delivering single-phase gaseous flow to at least two inlet passages of the apparatus.

Figure 14:
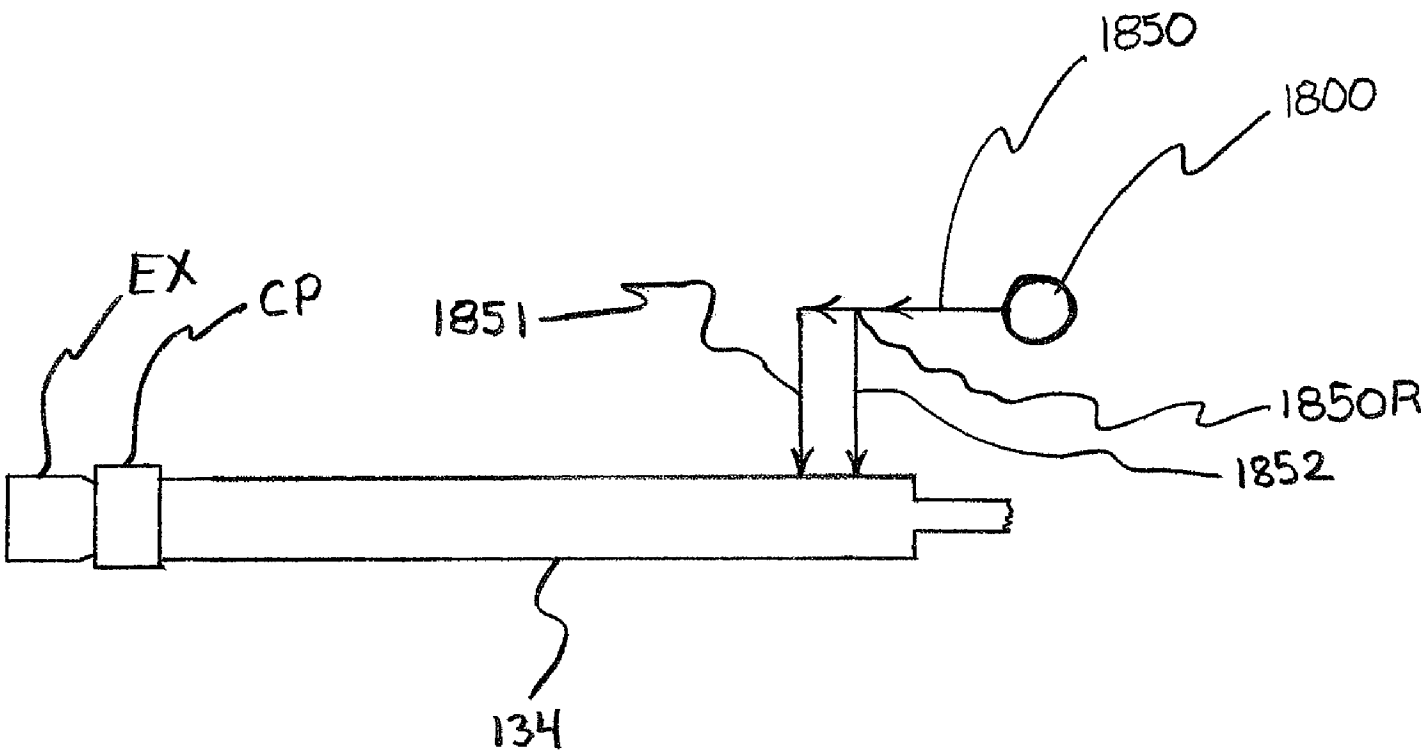
FIG. 14 is a schematic side view of an energy transfer apparatus wherein a single compressor (or other pressurized fluid source) is adapted to supply fluid to two fluid flow generators of the apparatus in accordance with certain embodiments of the invention.

In some cases, the apparatus is adapted such that the first generator 108A can receive fluid at one pressure while the second generator 108B receives fluid at a different pressure. This can be accomplished in different ways. FIG. 14 schematically illustrates exemplary embodiments wherein a single output flow from a compressor (or other pressurized fluid source) 1800 is divided into two separate flows leading respectively to two inlet passages of the energy transfer apparatus. Here, a single delivery line 1850 extends from the compressor 1800 to a branch point 1850R where the delivery line branches into two separate conduits 1851, 1852 leading respectively to the two inlet passages, which lead respectively to the first and second generators. Using such a system, the pressures can be regulated such that the first generator receives fluid at one pressure while the second generator receives fluid at a different pressure. This can be accomplished in any suitable way. For example, an appropriate pressure regulator (e.g., a pressure regulation valve) can be provided at the branch point 1850R. Skilled artisans will be familiar with various conventional options for achieving such pressure regulation.

Certain embodiments involve delivering a first inflow through a first inlet passage of the apparatus, and delivering a second inflow through a second inlet passage of the apparatus. In some of these embodiments, the first and second inflows are provided by delivering fluid of substantially the same chemical composition to both the first and second inlet passages. Thus, the apparatus can optionally be adapted to deliver to both generators 108A, 108B fluid of the same chemical composition (or of substantially the same chemical composition, optionally being a single-phase gaseous fluid).

Some embodiments provide the inlet device(s) 96, the first generator 108A, the second generator 108B, and the energy transfer tube 132 all as non-moving parts that remain stationary during operation of the apparatus.

The invention has exceptional scale-ability/size-ability. That is, the dimensions of the apparatus can be anywhere from tiny (e.g., cigarette size or smaller) to huge. As a result, one can provide virtually any desired amount of fluid flow. This allows the present apparatus and methods to have an incredibly wide range of applications.

The apparatus, for example, can be used as a refrigerator in many different systems. The computer cooling example, which is given as a test bench (for measuring performance) in U.S. Patent Application Publication No. 2006/0150643 ("the '643 publication"), is one embodiment. (In connection with that embodiment, the structure relating to the computer case in the '643 publication is incorporated herein by reference). The present apparatus 10 can be used to cool any integrated circuit, such as a CPU, chipset or graphics cards. In some embodiments, a computer server is operably coupled with a system that includes one or more apparatuses 10 of the present invention. One embodiment provides a data center in which a plurality of servers are located. Here, the data center is provided with one or more cooling units each comprising the present apparatus 10. It may be desirable to use a plurality of these apparatuses 10 in the data center to provide adequate cooling. Thus, there are numerous applications where the energy transfer apparatus 10 is used for cooling working equipment, such as electronics.

Skilled artisans will appreciate that the present apparatus and methods can be used for any air conditioning system. In one group of embodiments, the apparatus 10 is part of a heating, ventilation, or air conditioning (i.e., "HVAC") system for a building. In one particular embodiment, the apparatus 10 is part of an air conditioning unit, such as a central air conditioner for a building, a wall-mounted air conditioner (e.g., a room air conditioner), etc. Many different HVAC applications are possible.

In one group of embodiments, the apparatus 10 is used for cooling a vehicle. Any type of vehicle can be cooled using an appropriate system including one or more apparatuses 10 of the invention.

The apparatus 10 can also be used in a refrigerator for storing food or other items to be kept cool. Spot cooling embodiments are possible as well.

More generally, the apparatus 10 can be used for virtually any application where it is desired to cool a system, an area, a component, etc. Moreover, the apparatus can be used to produce hot and cold fluid streams for applications where it is desired to deliver hot fluid to a first system, area, or component, while simultaneously delivering cold fluid to a second system, area, or component.

Experiments were conducted to demonstrate use of multiple flow generators to change outlet temperatures. Table 1 below reports three such experiments.

TABLE 1

| Ambient temperature (° F.) | Relative humidity | Barometric pressure | Generator A inlet pressure (psi) | Generator A flow rate (cfm) | Generator B inlet pressure | Generator B flow rate (cfm) | Cold outlet temperature (° F.) | Hot outlet temperature (° F.) |
|---|---|---|---|---|---|---|---|---|
| 90 | 65% | 29.92 | 110 | 5 | 125 | 5 | −60 | 180 |
| 90 | 65% | 29.92 | 110 | 5 | 135 | 5 | −80 | 210 |
| 90 | 65% | 29.92 | 110 | 5 | 155 | 5 | −120 | 248 |

Thus, the outlet temperatures can be adjusted by simply changing the inlet pressure at generator B. The reported data, of course, are for one particular system. The performance of a given apparatus will depend on its size and configuration, and also on variations in the parameters reported in Table 1. Experiments similar to those reported in Table 1 have shown the energy removal of the present multiple-generator apparatus can be about three times that of a single-generator apparatus (like that disclosed in the above-noted '643 publication) of comparable dimensions.

While a preferred embodiment of the present invention has been described, it should be understood that various changes, adaptations and modifications may be made therein without departing from the spirit of the invention and the scope of the appended claims.

What is claimed is:

1. An apparatus for transferring energy by rotating fluid within the apparatus, the apparatus having a cold-fluid-discharge end and a hot-fluid-discharge end, the apparatus including an energy transfer tube and first and second fluid flow generators, the first and second generators each being adapted to create a rotating fluid flow at least part of which is located inside the energy transfer tube, both generators being adjacent to the cold-fluid-discharge end, the second generator being closer to the cold-fluid-discharge end than is the first generator, wherein the cold-fluid-discharge end comprises a cold fluid outlet, wherein the hot-fluid-discharge end comprises one or more hot fluid ports, and wherein the apparatus is adapted to provide single-phase gaseous flow through two inlet passages leading respectively to the first and second generators.

2. The apparatus of claim 1 wherein a single compressor is adapted to deliver the single-phase gaseous flow to both said inlet passages.

3. The apparatus of claim 2 wherein the apparatus is adapted such that the first generator can receive fluid at one pressure while the second generator receives fluid at a different pressure, wherein a single output flow from the compressor is divided into two separate flows leading respectively to said two inlet passages.

4. The apparatus of claim 3 wherein a single delivery line extends from the compressor to a branch point where the delivery line branches into two separate conduits leading respectively to the two inlet passages, which lead respectively to the first and second generators.

5. The apparatus of claim 4 wherein a valve at the branch point is adapted to regulate flow such that the first generator receives fluid at said one pressure while the second generator receives fluid at said different pressure.

6. The apparatus of claim 1 wherein the energy transfer tube is cylindrical with a non-conical shape.

7. The apparatus of claim 1 wherein the cold fluid outlet has an outflow temperature that can be adjusted by adjusting a pressure of fluid delivered to one of the two generators, defined as a clutching generator, while holding constant a pressure of fluid delivered to the other of the two generators.

8. The apparatus of claim 7 wherein the rotating fluid flow created by the clutching generator is an outermost rotating flow, which is located closer to an inside wall of the energy transfer tube than is the rotating fluid flow created by the other of the two generators.

9. The apparatus of claim 1 wherein the rotating fluid flow created by the second generator is an outermost rotating flow, which is located closer to an inside wall of the energy transfer tube than is the rotating fluid flow created by the first generator.

10. The apparatus of claim 1 wherein the first generator includes a passage configured to deliver pressurized fluid into a first fluid flow chamber so as to create a rotating flow in the first fluid flow chamber, the rotating flow created in the first fluid flow chamber being defined as the first rotating flow, and wherein the second generator includes a passage configured to deliver pressurized fluid into a second fluid flow chamber so as to create a rotating flow in the second fluid flow chamber, the rotating flow created in the second fluid flow chamber being defined as the second rotating flow.

11. The apparatus of claim 10 wherein a flow-delivery passage extends between the first and second fluid flow chambers, the first and second fluid flow chambers having internal diameters larger than an internal diameter of the flow-delivery passage.

12. The apparatus of claim 10 wherein a flow-delivery passage extends between the first and second fluid flow chambers, the flow-delivery passage having an internal diameter that is larger than an internal diameter of the energy transfer tube.

13. The apparatus of claim 10 wherein an extension tube extends from the second generator toward the cold-fluid outlet, said extension tube having an internal diameter adjacent to the second generator that is smaller than an internal diameter of the flow-delivery passage between the first and second fluid flow chambers.

14. The apparatus of claim 10 wherein the first generator surrounds the first fluid flow chamber and has a plurality of circumferentially spaced passages configured to deliver pressurized fluid into the first fluid flow chamber, and the second generator surrounds the second fluid flow chamber and has a plurality of circumferentially spaced passages configured to deliver pressurized fluid into the second fluid flow chamber.

15. The apparatus of claim 10 wherein the energy transfer tube has first and second ends, the energy transfer tube being in fluid communication with the first and second fluid flow chambers such that the first and second rotating flows extend respectively from the first and second fluid flow chambers, into the energy transfer tube, and toward the second end of the energy transfer tube, said one or more hot-fluid ports being adjacent to the second end of the energy transfer tube, wherein some fluid from the second rotating flow escapes through said one or more hot-fluid ports but a major portion of the second rotating flow, and at least a major portion of the first rotating flow, return back through the energy transfer tube toward its first end and escape through the cold-fluid outlet of the apparatus.

16. The apparatus of claim 10 wherein a flow-delivery passage extends between the first and second fluid flow chambers, wherein the energy transfer tube, the first fluid flow chamber, the flow-delivery passage, and the second fluid flow chamber are all coaxial to one another.

17. The apparatus of claim 1 wherein the hot-fluid-discharge end of the apparatus is partially closed by a structure comprising a flow-blocking wall, the flow-blocking wall being located radially inwardly from a plurality of hot-fluid ports.

18. The apparatus of claim 1 comprising one or more inlet devices adapted to deliver pressurized fluid through the two inlet passages, defined as first and second inlet passages, and into first and second inlet chambers, wherein the first generator includes a passage configured to receive pressurized fluid from the first inlet chamber and deliver that pressurized fluid into a first fluid flow chamber so as to create a rotating flow in the first fluid flow chamber, the rotating flow created in the first fluid flow chamber being defined as the first rotating flow, and wherein the second generator includes a passage configured to receive pressurized fluid from the second inlet chamber and deliver that pressurized fluid into a second fluid flow chamber so as to create a rotating flow in the second fluid flow chamber, the rotating flow created in the second fluid flow chamber being defined as the second rotating flow, and wherein said one or more inlet devices define separate first and second inlet paths such that a first supply flow at one pressure can be delivered to the first inlet chamber while a second supply flow at a different pressure can be delivered simultaneously to the second inlet chamber.

19. The apparatus of claim 18 wherein the first inlet chamber has an annular configuration, and said one or more inlet devices define the first inlet passage through which pressurized fluid is adapted to flow when being delivered to the first inlet chamber, the first inlet passage being oblique to a radius of the first inlet chamber, and wherein the second inlet chamber has an annular configuration, and said one or more inlet devices define the second inlet passage through which pressurized fluid is adapted to flow when being delivered to the second inlet chamber, the second inlet passage being oblique to a radius of the second inlet chamber.

20. The apparatus of claim 19 wherein said passage of the first generator lies in a plane inclined at an angle of at least one degree relative to a plane perpendicular to a central axis of the first fluid flow chamber, wherein said passage of the second generator lies in a plane inclined at an angle of at least one degree relative to a plane perpendicular to a central axis of the second fluid flow chamber, wherein said passage of the first generator has a curved configuration in a cross section taken along a plane perpendicular the central axis of the first fluid flow chamber, and said passage of the second generator has a curved configuration in a cross section taken along a plane perpendicular the central axis of the second fluid flow chamber.

21. The apparatus of claim 1 wherein the first and second generators are side-by-side.

22. The apparatus of claim 1 wherein the apparatus includes a dampener that isolates the energy transfer tube from external vibrations.

23. The apparatus of claim 22 wherein the dampener comprises an isolation tube that surrounds the energy transfer tube, leaving an isolation space between the energy transfer tube and the isolation tube.

24. The apparatus of claim 1 wherein the fluid flow generators are collectively adapted to create at least eight fluid flow layers extending through the energy transfer tube, said fluid flow layers being counted as found in a cross section taken along a plane lying on a central axis of the energy transfer tube, each of said eight fluid flow layers extending along at least a major length of the energy transfer tube.

25. A method of operating an apparatus adapted to transfer energy by rotating fluid within the apparatus, the apparatus having a cold-fluid-discharge end and a hot-fluid-discharge end, the apparatus including an energy transfer tube and first and second fluid flow generators, both generators being adjacent to the cold-fluid-discharge end, the second generator being closer to the cold-fluid-discharge end than is the first generator, wherein the cold-fluid-discharge end comprises a cold fluid outlet, and the hot-fluid-discharge end comprises one or more hot fluid ports, the method comprising delivering pressurized fluid from the first and second generators into first and second fluid flow chambers of the apparatus so as to create first and second rotating flows that then extend respectively from the first and second fluid flow chambers through the energy transfer tube toward the hot-fluid-discharge end of the apparatus, resulting in some fluid from the second rotating flow escaping through said one or more hot-fluid ports while a major portion of the second rotating flow, and at least a major portion of the first rotating flow, return back through the energy transfer tube toward the cold-fluid-discharge end and escape through the cold-fluid outlet, the apparatus including first and second inlet passages leading respectively to the first and second generators, the method comprising delivering single-phase gaseous flow to both of said inlet passages.

26. The method of claim 25 wherein the method comprises delivering a first inflow through said first inlet passage and delivering a second inflow through said second inlet passage, and wherein the first and second inflows are provided by delivering fluid of substantially the same chemical composition to both the first and second inlet passages.

27. The method of claim 25 wherein the method comprises delivering a first inflow through said first inlet passage and delivering a second inflow through said second inlet passage, the second inflow having a flow rate that is different than, but no more than 50% greater or less than, that of the first inflow.

28. The method of claim 25 wherein gas flow emanates from said one or more hot fluid ports during operation of the apparatus.

29. The method of claim 28 wherein, during operation of the apparatus, flow emanating from said one or more hot fluid ports consists essentially of gas.

30. The method of claim 25 wherein the cold-fluid outlet has an adjustable outflow temperature, and wherein said outflow temperature can be adjusted by adjusting a pressure of fluid delivered to one of the two generators while holding constant a pressure of fluid delivered to the other of the two generators.

31. The method of claim 30 wherein said outflow temperature can be adjusted by adjusting the pressure of the fluid delivered to one of the two generators, defined as a clutching generator, while holding constant the pressure of the fluid delivered to the other of the two generators, wherein the rotating fluid flow created by the clutching generator is an outermost rotating flow, which is located closer to an inside wall of the energy transfer tube than is the rotating fluid flow created by the other of the two generators.

32. The method of claim 25 wherein the rotating fluid flow created by the second generator is an outermost rotating flow, which is located closer to an inside wall of the energy transfer tube than is the rotating fluid flow created by the first generator.

33. The method of claim 25 wherein a single compressor is used to deliver the single-phase gaseous flow to both said inlet passages.

34. The method of claim 33 wherein the apparatus is operated such that the first generator receives fluid at one pressure while the second generator receives fluid at a different pressure, wherein a single output flow from the compressor is divided into two separate flows leading respectively to said two inlet passages.

35. The apparatus of claim 34 wherein a single delivery line extends from the compressor to a branch point where the delivery line branches into two separate conduits leading respectively to the two inlet passages, which lead respectively to the first and second generators, wherein a valve at the branch point is used to regulate flow such that the first generator receives fluid at said one pressure while the second generator receives fluid at said different pressure.

36. The method of claim 25 wherein the apparatus exhibits acoustic toning during operation.

37. The method of claim 36 wherein the acoustic toning is characterized by an acoustic tone propagating over a plurality of fluid flow layers in the energy transfer tube.

38. The method of claim 37 wherein the acoustic tone exists over substantially an entire length of the energy transfer tube.

39. The method of claim 25 wherein the first generator receives pressurized fluid that is delivered into the apparatus at a first inlet pressure of about 115 psi or less.

40. The method of claim 25 wherein the second generator is operated at a higher pressure than is the first generator.

41. The method of claim 25 wherein the first generator receives pressurized fluid that is delivered into the apparatus at a first inlet pressure while simultaneously the second generator receives pressurized fluid that is delivered into the apparatus at a second inlet pressure, wherein the second inlet pressure is greater than the first inlet pressure by at least 10 psi.

42. The method of claim 25 wherein the fluid flow generators are operated to collectively create at least eight fluid flow layers extending through the energy transfer tube, said fluid flow layers being counted as found in a cross section taken along a plane lying on a central axis of the energy transfer tube, each of said eight fluid flow layers extending along at least a major length of the energy transfer tube.

43. The method of claim 25 wherein the method comprises beginning operation of the apparatus by starting pressurized fluid flow through the first generator before starting pressurized fluid flow through the second generator.

44. The method of claim 43 wherein the pressurized fluid flow through the second generator is started after: i) pressurized fluid flow through the first generator has been staffed, and ii) an acoustic tone has been generated in the apparatus.

45. The method of claim 25 wherein the energy transfer tube is cylindrical with a non-conical shape.

46. The method of claim 25 wherein the first and second generators are non-moving so as to remain stationary during operation of the apparatus.

47. The method of claim 25 wherein the pressurized fluid delivered from the first and second generators into the first and second fluid flow chambers comprises at least one fluid selected from the group consisting of air and inert gas.

48. The method of claim 25 wherein the energy transfer tube bounds a generally cylindrical interior space, and wherein operation of the apparatus produces a stream of cold fluid from the cold-fluid-discharge end while simultaneously producing a stream of hot fluid from the hot-fluid-discharge end, the stream of cold fluid being at a lower temperature than pressurized fluid delivered into the apparatus, the stream of hot fluid being at a higher temperature than pressurized fluid delivered into the apparatus.

49. The method of claim 25 wherein a flow-delivery passage extends between the first and second fluid flow chambers, the first and second fluid flow chambers having internal diameters larger than an internal diameter of the flow-delivery passage.

50. The method of claim 25 wherein a flow-delivery passage extends between the first and second fluid flow chambers, the flow-delivery passage having an internal diameter that is larger than an internal diameter of the energy transfer tube.

51. The method of claim 25 wherein an extension tube extends from the second generator toward the cold-fluid outlet, said extension tube having an internal diameter adjacent to the second generator that is smaller than an internal diameter of a flow-delivery passage located between the first and second fluid flow chambers.

52. The method of claim 25 wherein operation of the apparatus results in a stream of cold fluid flowing from the cold-fluid-discharge end while simultaneously a stream of hot fluid flows from the hot-fluid-discharge end, the stream of cold fluid being at a temperature that is at least 200 degrees Fahrenheit lower than the temperature of the stream of hot fluid.

53. A method of operating an apparatus adapted to transfer energy by rotating fluid within the apparatus, the apparatus having a cold-fluid-discharge end and a hot-fluid-discharge end, the apparatus including an energy transfer tube and first and second fluid flow generators, both generators being adjacent to the cold-fluid-discharge end, the second generator being closer to the cold-fluid-discharge end than is the first generator, wherein the cold-fluid-discharge end comprises a cold fluid outlet, and the hot-fluid-discharge end comprises one or more hot fluid ports, the method comprising delivering pressurized fluid from the first and second generators into first and second fluid flow chambers of the apparatus so as to create first and second rotating flows that then extend respectively from the first and second fluid flow chambers through the energy transfer tube toward the hot-fluid-discharge end of the apparatus, resulting in some fluid from the second rotating flow escaping through said one or more hot-fluid ports while a major portion of the second rotating flow, and at least a major portion of the first rotating flow, return back through the energy transfer tube toward the cold-fluid-discharge end and escape through the cold-fluid outlet, the apparatus including first and second inlet passages leading respectively to the first and second generators, the method comprising delivering a first inflow through said first inlet passage and delivering a second inflow through said second inlet passage, and wherein the first and second inflows are provided by delivering fluid of substantially the same chemical composition to both the first and second inlet passages.

54. The method of claim 53 wherein the second inflow has a flow rate that is different than, but no more than 50% greater or less than, that of the first inflow.

55. The method of claim 53 wherein gas flow emanates from said one or more hot fluid ports during operation of the apparatus.

56. The method of claim 55 wherein, during operation of the apparatus, flow emanating from said one or more hot fluid ports consists essentially of gas.

57. The method of claim 53 wherein the cold-fluid outlet has an adjustable outflow temperature, and wherein said outflow temperature can be adjusted by adjusting a pressure of fluid delivered to one of the two generators while holding constant a pressure of fluid delivered to the other of the two generators.

58. The method of claim 53 wherein said outflow temperature can be adjusted by adjusting the pressure of the fluid delivered to one of the two generators, defined as a clutching generator, while holding constant the pressure of the fluid delivered to the other of the two generators, wherein the rotating fluid flow created by the clutching generator is an outermost rotating flow, which is located closer to an inside wall of the energy transfer tube than is the rotating fluid flow created by the other of the two generators.

59. The method of claim 53 wherein the rotating fluid flow created by the second generator is an outermost rotating flow, which is located closer to an inside wall of the energy transfer tube than is the rotating fluid flow created by the first generator.

60. The method of claim 53 wherein the apparatus exhibits acoustic toning during operation.

61. The method of claim 60 wherein the acoustic toning is characterized by an acoustic tone propagating over a plurality of fluid flow layers in the energy transfer tube.

62. The method of claim 61 wherein the acoustic tone exists over substantially an entire length of the energy transfer tube.

63. A method of operating an apparatus adapted to transfer energy by rotating fluid within the apparatus, the apparatus having a cold-fluid-discharge end and a hot-fluid-discharge end, the apparatus including an energy transfer tube and first and second fluid flow generators, both generators being adjacent to the cold-fluid-discharge end, the second generator being closer to the cold-fluid-discharge end than is the first generator, wherein the cold-fluid-discharge end comprises a cold fluid outlet, and the hot-fluid-discharge end comprises one or more hot fluid ports, the method comprising delivering pressurized fluid from the first and second generators into first and second fluid flow chambers of the apparatus so as to create first and second rotating flows that then extend respectively from the first and second fluid flow chambers through the energy transfer tube toward the hot-fluid-discharge end of the apparatus, resulting in some fluid from the second rotating flow escaping through said one or more hot-fluid ports while a major portion of the second rotating flow, and at least a major portion of the first rotating flow, return back through the energy transfer tube toward the cold-fluid-discharge end and escape through the cold-fluid outlet, the apparatus including first and second inlet passages leading respectively to the first and second generators, the method comprising delivering a first inflow through said first inlet passage and delivering a second inflow through said second inlet passage, and wherein the second inflow has a flow rate that is different than, but no more than 50% greater or less than, that of the first inflow.

64. The method of claim 63 wherein gas flow emanates from said one or more hot fluid ports during operation of the apparatus.

65. The method of claim 64 wherein, during operation of the apparatus, flow emanating from said one or more hot fluid ports consists essentially of gas.

66. The method of claim 63 wherein the cold-fluid outlet has an adjustable outflow temperature, and wherein said outflow temperature can be adjusted by adjusting a pressure of fluid delivered to one of the two generators while holding constant a pressure of fluid delivered to the other of the two generators.

67. The method of claim 63 wherein said outflow temperature can be adjusted by adjusting the pressure of the fluid delivered to one of the two generators, defined as a clutching generator, while holding constant the pressure of the fluid delivered to the other of the two generators, wherein the rotating fluid flow created by the clutching generator is an outermost rotating flow, which is located closer to an inside wall of the energy transfer tube than is the rotating fluid flow created by the other of the two generators.

68. The method of claim 63 wherein the rotating fluid flow created by the second generator is an outermost rotating flow, which is located closer to an inside wall of the energy transfer tube than is the rotating fluid flow created by the first generator.

69. The method of claim 63 wherein the apparatus exhibits acoustic toning during operation.

70. The method of claim 69 wherein the acoustic toning is characterized by an acoustic tone propagating over a plurality of fluid flow layers in the energy transfer tube.

71. The method of claim 70 wherein the acoustic tone exists over substantially an entire length of the energy transfer tube.

* * * * *